US008998363B2

(12) United States Patent
Kawagoe

(10) Patent No.: US 8,998,363 B2
(45) Date of Patent: Apr. 7, 2015

(54) INK-JET PRINTER

(71) Applicant: Brother Kogyo Kabushiki Kaisha, Nagoya-shi, Aichi-ken (JP)

(72) Inventor: Masako Kawagoe, Nagoya (JP)

(73) Assignee: Brother Kogyo Kabushiki Kaisha, Nagoya-Shi, Aichi-Ken (JP)

( * ) Notice: Subject to any disclaimer, the term of this patent is extended or adjusted under 35 U.S.C. 154(b) by 0 days.

(21) Appl. No.: 13/628,993

(22) Filed: Sep. 27, 2012

(65) Prior Publication Data

US 2013/0135375 A1 May 30, 2013

(30) Foreign Application Priority Data

Nov. 30, 2011 (JP) ..... 2011-262555

(51) Int. Cl.
*B41J 29/38* (2006.01)
*B41J 2/21* (2006.01)
*B41J 11/00* (2006.01)

(52) U.S. Cl.
CPC ..... *B41J 2/2132* (2013.01); *B41J 11/0065* (2013.01)

(58) Field of Classification Search
CPC .... B41J 29/38; B41J 2/04505; B41J 2/04573; B41J 2/01; B41J 2/2139
USPC ..... 347/5–19
See application file for complete search history.

(56) References Cited

U.S. PATENT DOCUMENTS

| | | | | |
|---|---|---|---|---|
| 2007/0216718 | A1 | 9/2007 | Mizuno | |
| 2010/0309242 | A1 | 12/2010 | Chikuma et al. | |
| 2011/0234673 | A1* | 9/2011 | Ueshima | 347/14 |

FOREIGN PATENT DOCUMENTS

| | | | | |
|---|---|---|---|---|
| JP | 63-1562 | A | 1/1988 | |
| JP | 2001-114453 | A | 4/2001 | |
| JP | 2005132066 | * | 5/2005 | B41J 2/01 |
| JP | 2007-245485 | A | 9/2007 | |
| JP | 2007326315 | * | 12/2007 | |
| JP | 2008-221748 | A | 9/2008 | |
| JP | 2008-254303 | A | 10/2008 | |
| JP | 2009-028901 | A | 2/2009 | |
| JP | 2009233962 | * | 10/2009 | |
| JP | 2010-280205 | A | 12/2010 | |

OTHER PUBLICATIONS

Notice of Reasons for Rejection in Office Action issued in related Japanese application No. 2011-262555, mailed Jan. 6, 2015.

* cited by examiner

*Primary Examiner* — Alessandro Amari
*Assistant Examiner* — Michael Konczal
(74) *Attorney, Agent, or Firm* — Merchant & Gould PC

(57) ABSTRACT

An ink-jet printer which records an image by discharging an ink onto a recording medium includes: an ink-jet head having nozzles for discharging ink droplets; a carriage which makes the ink-jet head to scan in a main scanning direction; a transport mechanism which transports the recording medium in a transporting direction intersecting the main scanning direction; and a discharge controller configured to control the ink-jet head to discharge the ink droplets from the nozzles. The discharge controller is configured to change a discharge timing of the ink droplets from reference timing to deviate the landing positions of the ink droplets in a case that at least one of the alignment direction of the nozzles and the transport direction is inclined with respect to a sub scanning direction perpendicular to the main scanning direction.

20 Claims, 13 Drawing Sheets

INK-JET PRINTER

CROSS REFERENCE TO RELATED APPLICATION

The present application claims priority from Japanese Patent Application No. 2011-262555, filed on Nov. 30, 2011, the disclosure of which is incorporated herein by reference in its entirety.

BACKGROUND OF THE INVENTION

1. Field of the Invention

The present invention relates to an ink-jet printer which records an image on a recording medium by discharging an ink from nozzles.

2. Description of the Related Art

As an ink-jet printer which records an image on a recording medium by discharging an ink or inks from nozzles, Japanese Patent Application Laid-open No. 2008-251303 describes an ink-jet printer which discharges an ink or inks from a plurality of nozzles formed on an ink-jet head which is reciprocatively movable in a main scanning direction together with a carriage and which records an image on a recording medium transported in parallel to a sub scanning direction (secondary scanning direction). In the case of the ink-jet printer described in Japanese Patent Application Laid-open No. 2008-254303, the plurality of nozzles are aligned in the sub scanning direction. In a case that the positional accuracy of the nozzles is unsatisfactory and the alignment direction of the nozzles is inclined with respect to the sub scanning direction, the ink is discharged from the nozzles in the first scanning at the same discharge timing as that provided when the alignment direction of the nozzles is parallel to the sub scanning direction. In the second scanning and the followings, the discharge timing of the ink to be discharged from the nozzles is advanced or delayed depending on the inclination of the alignment direction of the nozzles so that the landing position of the ink is deviated thereby in the main scanning direction.

In this procedure, if the landing position of the ink are not deviated, then the ink, which is discharged from the nozzle positioned at the end on the upstream side in the transport direction in certain scanning, has the landing position which is deviated in the main scanning direction from the landing position of the ink which is discharged from the nozzle positioned at the end on the downstream side in the transport direction in the next scanning, and the image quality of the image to be recorded is deteriorated. In view of the above, in the ink-jet printer described in Japanese Patent Application Laid-open No. 2008-254303, the deviation of the ink landing position is eliminated by deviating the ink landing position in the main scanning direction as described above. Accordingly, the image quality of the image to be recorded is improved.

In this context, in the ink-jet printer described in Japanese Patent Application Laid-open No. 2008-254303, the amount of deviation of the ink landing position is more increased in the scanning to be performed later in relation to the second scanning and the followings. Therefore, the portion, which is recorded in the first scanning, is recorded at a substantially central portion of the recording medium in relation to the main scanning direction. The portions, which are recorded by the scanning performed later, are recorded at positions deviated toward one side from the central portion of the recording medium with respect to the main scanning direction. A large difference appears in the lengths in relation to the main scanning direction of the blank spaces or margins disposed on the both sides in relation to the main scanning direction of the image recorded on the recording medium.

SUMMARY OF THE INVENTION

An object of the present invention is to provide an ink-jet printer which is capable of recording an image so that the difference in the lengths with respect to the main scanning direction of blank spaces or margins of a recording medium on which the image is recorded is decreased, while improving the image quality of the recorded image.

According to an aspect of the present invention, there is provided, an ink-jet printer which records an image by discharging ink droplets of an ink onto a recording medium, the ink-jet printer including: an ink-jet head which has an ink discharge surface formed with a plurality of nozzles front which the ink droplets are discharged; a carriage which carries the ink-jet head thereon and which makes the ink-jet head to scan by reciprocating in a main scanning direction parallel to the ink discharge surface; a transport mechanism which transports the recording medium in a transport direction intersecting the main scanning direction, the ink droplets discharged from the nozzles being landed on the recording medium; and a discharge controller which is configured to control the ink-jet head to discharge the ink droplets from the nozzles, wherein: the nozzles form a nozzle row by being aligned in an alignment direction intersecting the main scanning direction; the discharge controller is configured to control the ink-jet head to discharge the ink droplets from the nozzles at a predetermined reference timing in a case that the alignment direction and the transport direction are along the ink discharge surface and parallel to a sub scanning direction perpendicular to the main scanning direction; and in a case that at least one of the alignment direction and the transport direction is inclined with respect to the sub scanning direction, the discharge controller is configured to perform the control, in each of scanning operations of the ink-jet head, such that: under a condition that a reference nozzle, which belongs to the nozzles, is opposed to a central portion of an image recording area of the recording medium with respect to the sub scanning direction, the discharge controller is configured to control the ink-jet head to discharge the ink droplets from the nozzles at the reference timing to land on predetermined reference landing positions in the image recording area; under a condition that the reference nozzle is opposed to an upstream side portion disposed on an upstream side in the transport direction as compared with the central portion of the image recording area, the discharge controller is configured to change, from the reference timing, a discharge timing at which the ink droplets are discharged from the nozzles to deviate landing positions of the ink droplets to one side in the main scanning direction with respect to the reference landing positions; and under a condition that the reference nozzle is opposed to a downstream side portion disposed on a downstream side in the transport direction as compared with the central portion of the image recording area, the discharge controller is configured to change the discharge timing from the reference timing to deviate the landing positions of the ink droplets to the other side in the main scanning direction with respect to the reference landing positions.

The ink-jet printer according to the aspect of the present invention performs the operation (hereinafter referred to as "scanning") in which the ink droplets are discharged from the ink-jet head while moving the carriage, the operation being repeated in order to record the image on the recording medium, wherein the deviation with respect to the main scanning direction disappears or the deviation decreases between the landing position of an ink droplet discharged from the nozzle positioned at the end on the upstream side in the transport direction in certain scanning included in the scanning described above and the landing position of an ink droplet discharged from the nozzle positioned at the end on the downstream side in the transport direction in the next scanning. Therefore, it is possible to improve the image quality of the recorded image. Further, the landing positions are not deviated when the reference nozzle is opposed to the center of the image recording area, while the landing positions are deviated in the main scanning direction when the reference nozzle is opposed to the upstream side portion and when the reference nozzle is opposed to the downstream side portion. Therefore, the difference in the length with respect to the main scanning direction, which is generated by deviating the landing positions, can be decreased between the blank spaces disposed on the both sides of the recorded image with respect to the main scanning direction.

DESCRIPTION OF THE PREFERRED EMBODIMENTS

Figure 1:
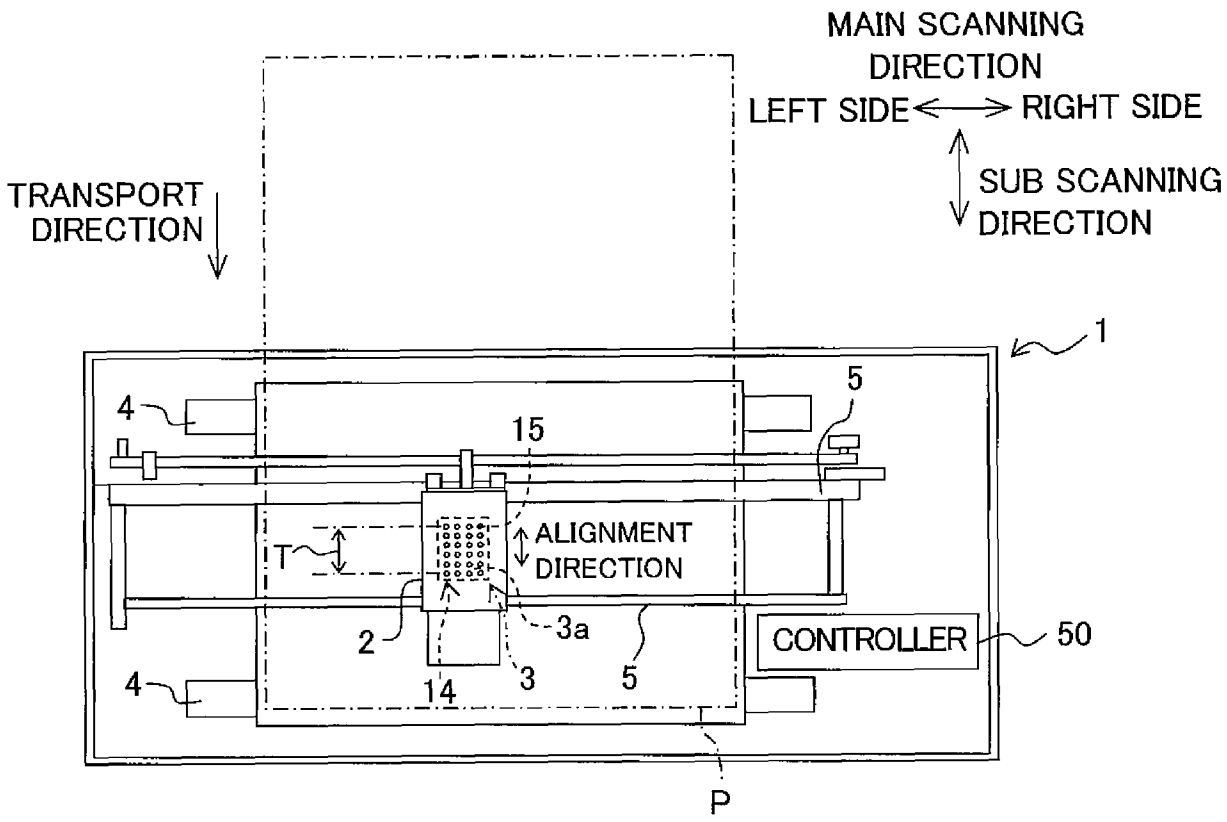
FIG. 1 shows a schematic arrangement of a printer according to an embodiment of the present teaching.

As shown in FIG. 1, an ink-jet printer 1 according to an embodiment of the present teaching is provided with, for example, a carriage 2, an inkjet head 3, and recording paper transport rollers 4. The operation of the ink-jet printer 1 is controlled by a controller 50. The following explanation will be made while defining the right side and the left side in the main scanning direction described later on as shown in FIG. 1.

The carriage 2 is reciprocatively movable in the main scanning direction along two guide rails 5. The ink-jet head 3 is carried on the carriage 2. The ink-jet head 3 discharges an ink or inks from a plurality of nozzles 15 formed on an ink discharge surface 3*a* which is the lower surface thereof and which extends in the main scanning direction and the sub scanning direction perpendicular to the main scanning direction as viewed in a plan view.

The plurality of nozzles 15 form nozzle rows 14 each of which is aligned in the alignment direction parallel to the sub scanning direction. The ink-jet head 3 has the four nozzle rows 14 which are arranged in the main scanning direction.

The recording paper transport rollers 4 transport the recording paper P (recording medium) in the transport direction which is parallel to the sub scanning direction. In this arrangement, the recording paper transport rollers 4 can transport a plurality of types of the recording paper including, for example, the recording paper of A4 size and the recording paper P of A3 size as the recording paper P. In this case, the recording paper of A4 size is transported in such an orientation (direction) that the long side direction thereof is parallel to the main scanning direction as shown by solid lines in FIG. 1. The recording paper P of A3 size is transported in such an orientation that the short side direction thereof is parallel to the main scanning direction as shown by alternate and short dash lines in FIG. 1. The length in the long side direction of the recording paper of A4 size is actually the same as the length in the short side direction of the recording paper of A3 size. However, in FIG. 1, in order to depict the drawing more comprehensively, the recording paper of A3 size is depicted as having a size which is one size smaller than the actual size. In this embodiment, the recording paper transport rollers correspond to the transport mechanism according to the present teaching.

In the ink-jet printer 1, the operation (scanning), in which the inks are discharged from the plurality of nozzles 15 of the ink-jet head 3, is repeatedly performed during the period in which the carriage 2 is moved rightwardly (to the right side) in the main scanning direction and during the period in which the carriage 2 is moved leftwardly (to the left side). Further every time when the scanning is completed, the recording paper P is transported by the recording paper transport rollers 4 in the transport direction by the transport amount T corresponding to the length of the nozzle row 14 in relation to the sub scanning direction. Accordingly, an image is recorded on the recording paper P. The recording paper P, on which the recording of the image has been completed, is discharged by the recording paper transport roller 4.

Figure 2:
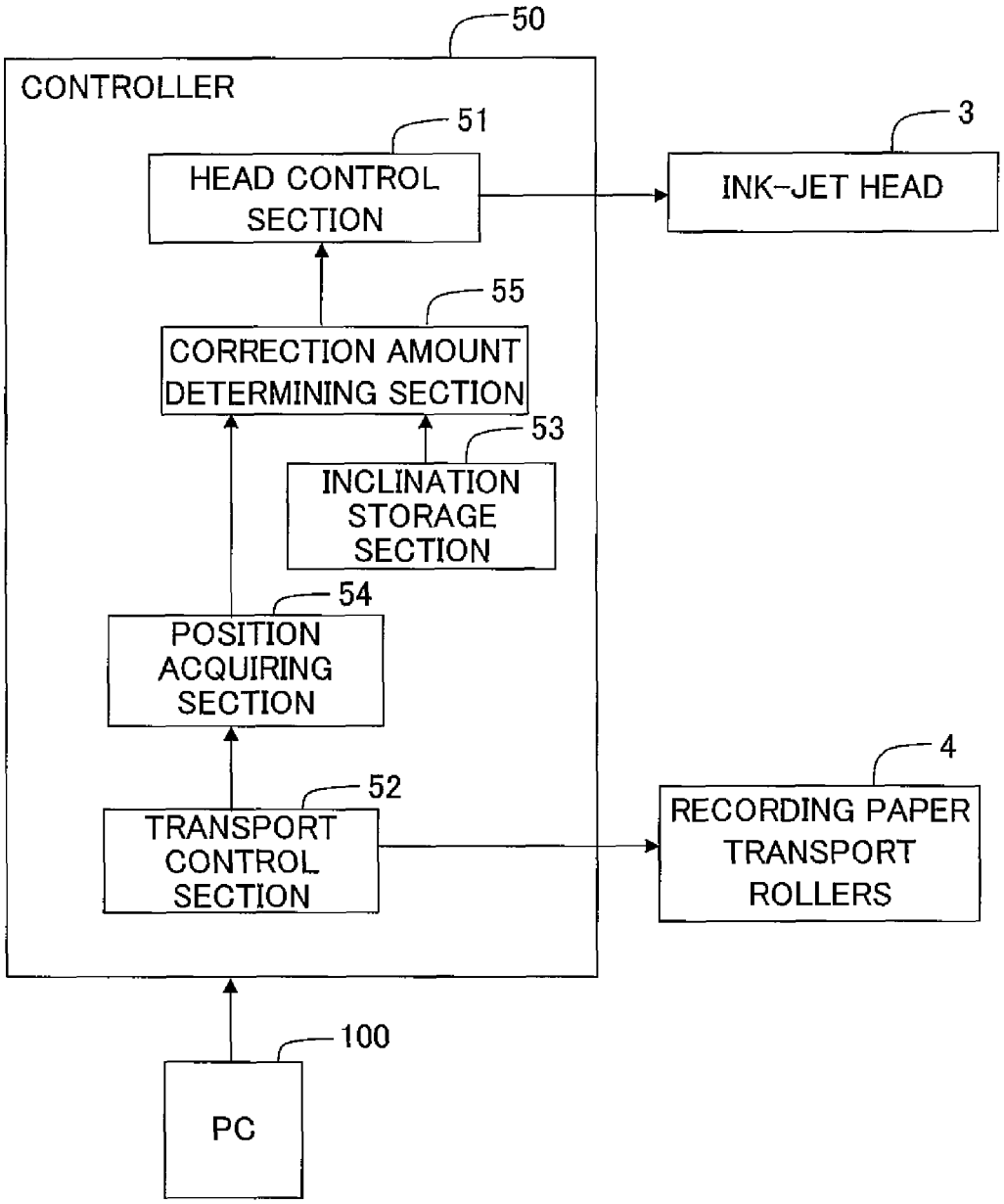
FIG. 2 shows a functional block diagram of a controller shown in FIG. 1.

Next, an explanation will be made about the controller 50 which controls the operation of the ink-jet printer 1. The controller 50 is composed of, for example, CPU (Central Processing Unit), ROM (Read Only Memory), and RAM (Random Access Memory). These components operate, for example, as a head control section 51, a transport control section 52, an inclination storage section 53, a position acquiring section 54, and a correction amount determining section 55 as shown in FIG. 2. The head control section 51 controls the operation of the ink-jet head 3 including, for example, the discharge of the ink or inks from the nozzles 15. The transport control section 52 controls the operation of the recording paper transport rollers 4.

The inclination storage section 53 stores the inclinations of the alignment direction of the plurality of nozzles 15 for constructing each of the nozzle rows 14 and the transport direction of the recording paper P transported by the recording paper transport rollers 4 with respect to the sub scanning direction. This feature will be explained in detail below. In principle, any one of the alignment direction of the nozzles 15 and the transport direction of the recording paper P should be parallel to the sub scanning direction as described above. However, the alignment direction of the nozzles 15 and the transport direction of the recording paper P are actually inclined with respect to the sub scanning direction in some cases, for example, due to the tolerance (allowance) of the parts for constructing the ink-jet printer 1 and the attachment error of the parts upon the production of the ink-jet printer 1. The inclination storage section 53 stores the angles of the alignment direction of the nozzles 15 and the transport direction of the recording paper P with respect to the sub scanning direction respectively. The angles of the alignment direction of the nozzles 15 and the transport direction of the recording paper P with respect to the sub scanning direction can be acquired, for example, by recording a test image on the recording paper when the ink-jet printer 1 is produced.

The position acquiring section 54 acquires the position of the recording paper P. Specifically, the position acquiring section 54 acquires which portion of the recording paper P is opposed to the ink-jet head 3, for example, on the basis of the distance by which the recording paper P is transported by the recording paper transport rollers 4. The correction amount determining section 55 determines the correction amount of the discharge timing for discharging the ink from the plurality of nozzles 15, on the basis of the inclinations of the alignment direction of the nozzles 15 and the transport direction of the recording paper P stored in the inclination storage section 53 and the position of the recording paper P acquired by the position acquiring section 54.

In this embodiment, a combination of the head control section 51, the inclination storage section 53, the position acquiring section 54, and the correction amount determining section 55 corresponds to the discharge controller according to the present teaching.

Figure 3:
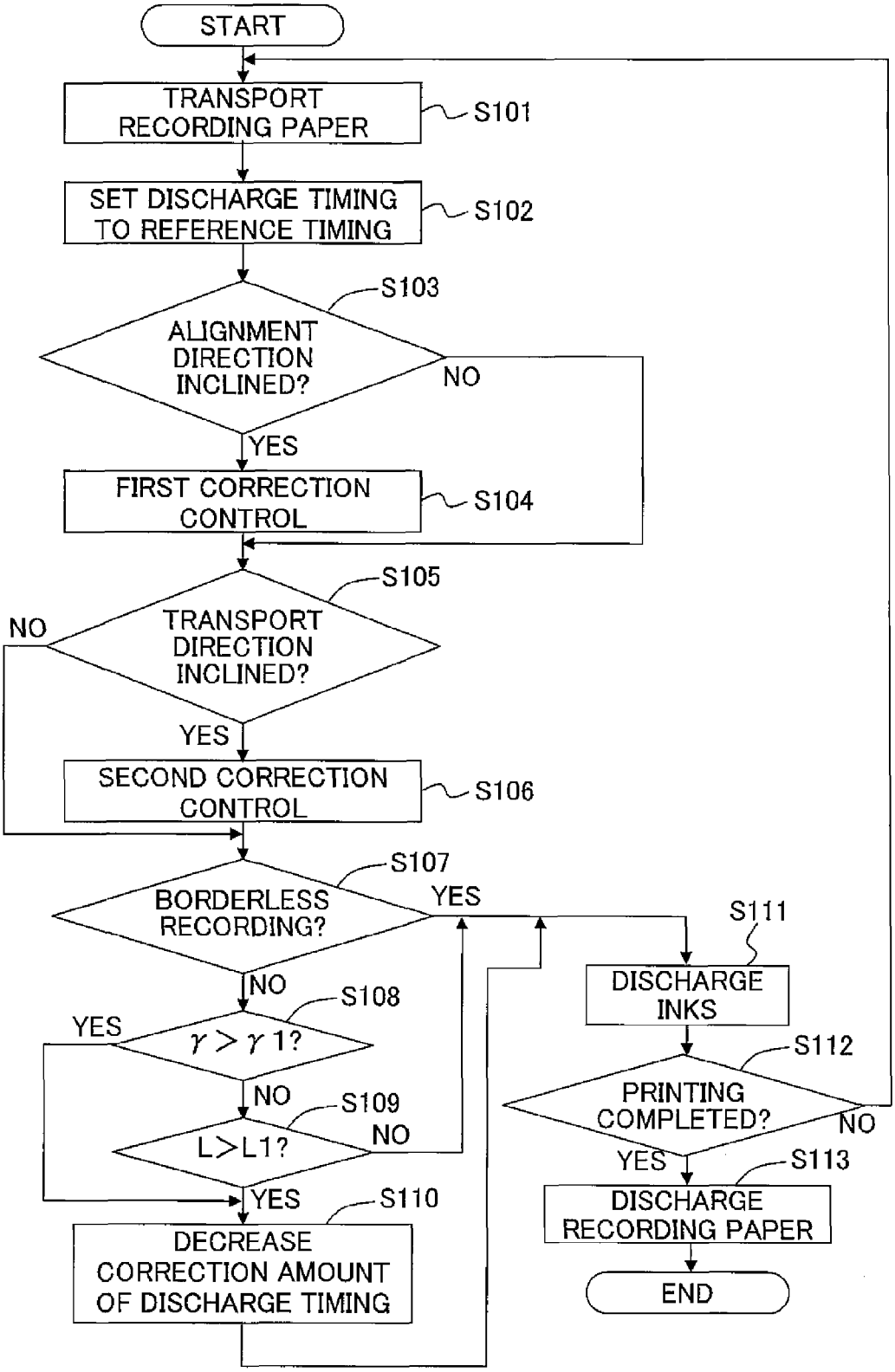
FIG. 3 shows a flow chart illustrating the control performed when an image is recorded by using the printer shown in FIG. 1.

Next, an explanation will be made by using flow charts shown in FIGS. 3 to 5 about the control performed when the image is recorded by means of the ink-jet printer 1. When the image is recorded by means of the ink-jet printer 1, then the recording paper P is firstly transported by means of the recording paper transport rollers 4 as shown in FIG. 3 (Step S101, hereinafter simply referred to, for example, as "S101"), and thus the recording paper P is transported to the position at which the portion for allowing the ink or inks discharged from the ink-jet head 3 to land thereon is opposed to the ink-jet head 3.

Subsequently, the discharge timing for discharging the ink from the nozzles 15 is set to the reference timing which is the discharge timing at which it is assumed that both of the alignment direction of the nozzles 15 and the transport direction of the recording paper P are parallel to the sub scanning direction (S102). If the alignment direction of the nozzles 15 is parallel to the sub scanning direction (S103: NO), the routine proceeds to S105 as it is. In other words, the correction amount of the discharge timing for discharging the ink from the plurality of nozzles 15 based on the inclination of the alignment direction of the nozzles 15 is zero. If the alignment direction of the nozzles 15 is inclined with respect to the sub scanning direction (S103: YES), the routine proceeds to S105 described later on after performing the first correction control explained below (S104).

Figure 4A:
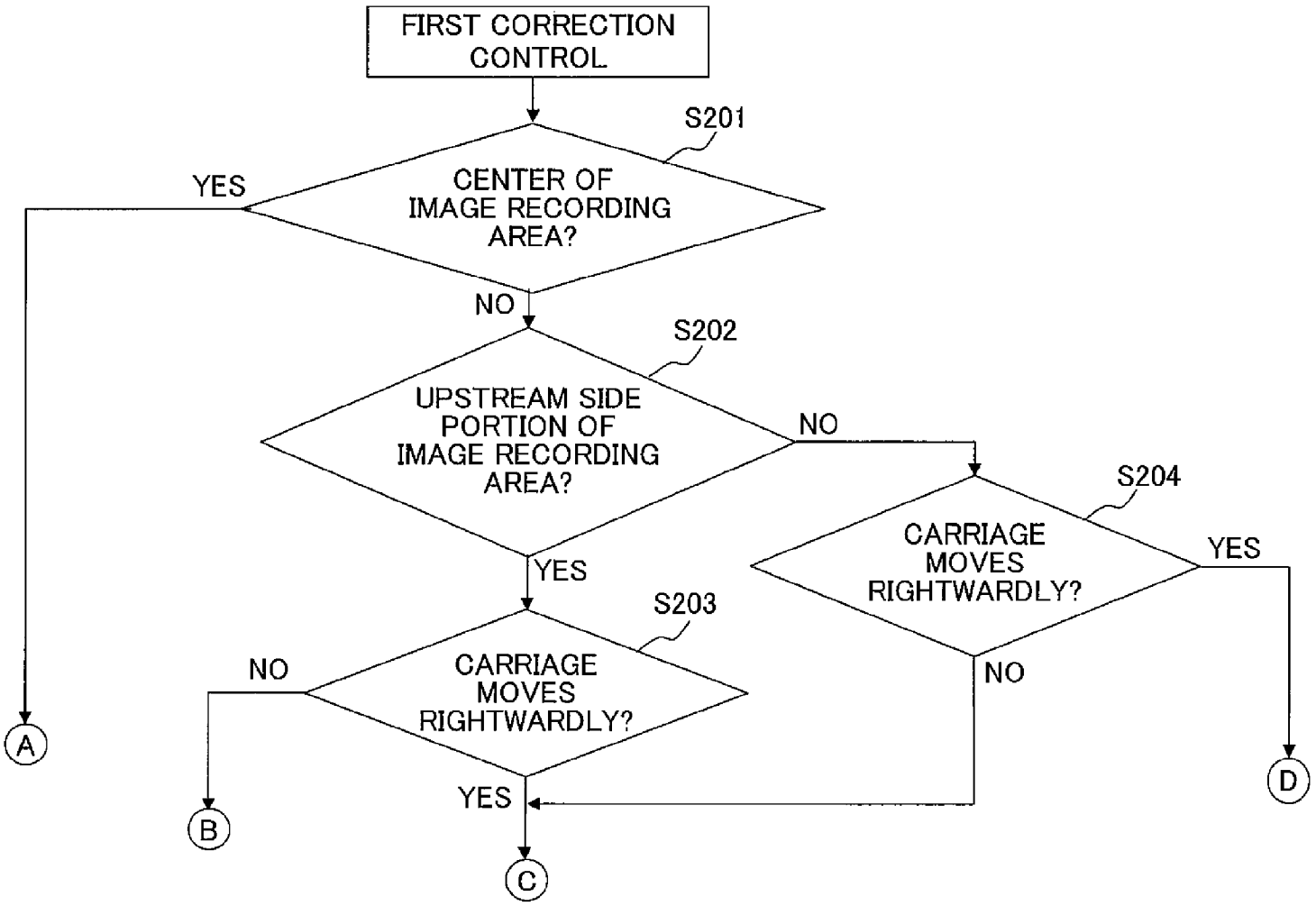
FIGS. 4A and 4B show a flow chart illustrating the flow of the first correction control shown in FIG. 3.
Figure 4B:
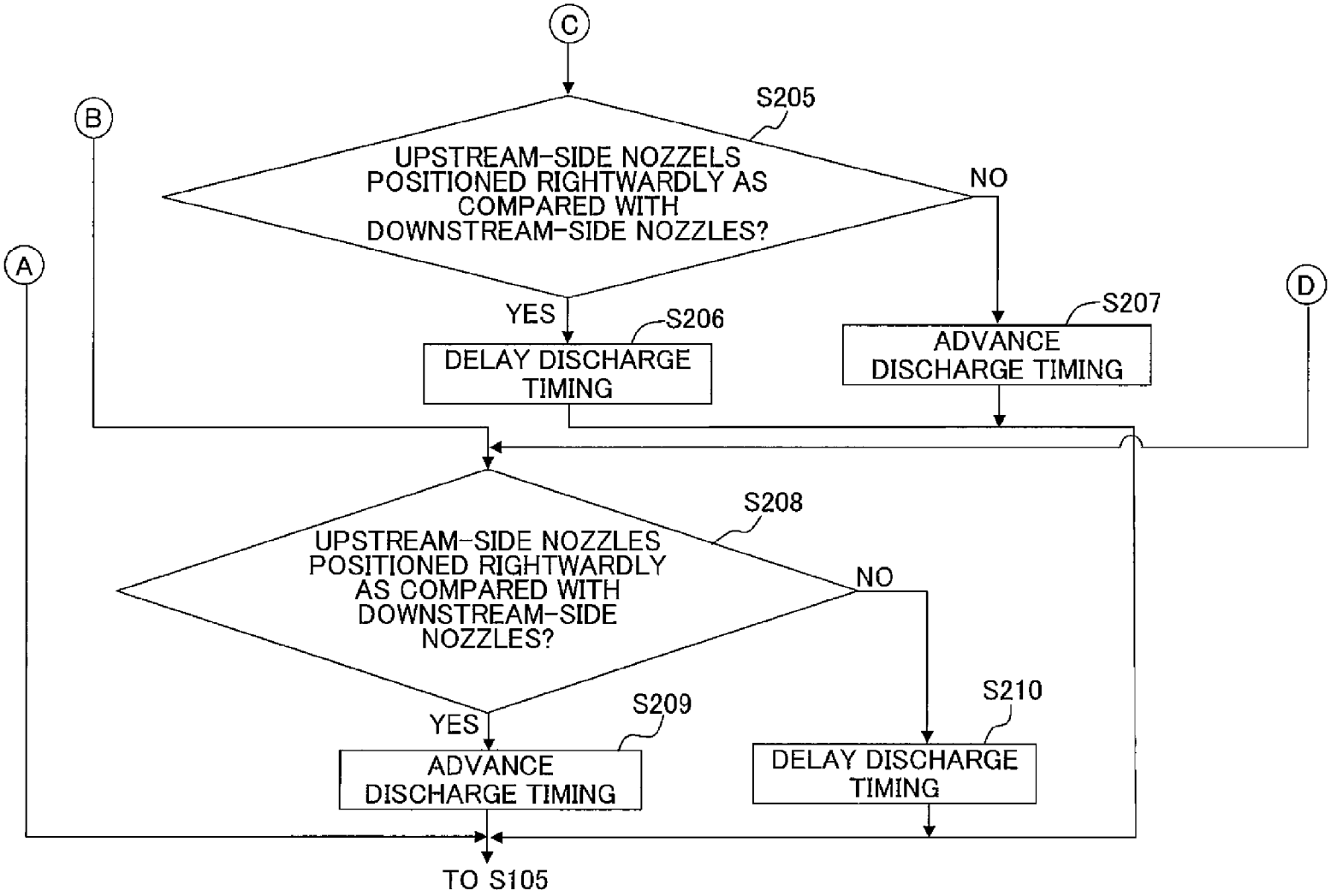

In the first correction control, as shown in FIG. 4, it is judged whether or not the reference nozzle 15, which is formed, for example, at the center in the alignment direction and which is included in the nozzles belonging to each of the nozzle rows 14 of the ink-jet head 3, is opposed to the center of the image recording area for recording the image thereon with respect to the sub scanning direction (S201). Specifically, when the correction amount determining section 55 receives an information, which relates to the center of the image recording area (namely, the center of the image) with respect to the sub scanning direction, together with the image data from an external apparatus such as PC 100 or the like, the correction amount determining section 55 judges whether or not the position of the reference nozzle 15 in the sub scanning direction is coincident with the center of the image recording area in the sub scanning direction. If the reference nozzle 15 is opposed to the center of the image recording area in relation to the sub scanning direction (S201: YES), the routine proceeds to S105 described later on as it is, without performing the correction of the discharge timing as explained below.

On the other hand, if the reference nozzle 15 is opposed to the portion (upstream side portion) of the image recording area disposed on the upstream side as compared with the center with respect to the sub scanning direction (S201: NO, S202: YES), the routine proceeds as follows. That is, if the movement direction of the carriage 2 is directed rightwardly (S20): YES), the routine proceeds to S205 described later on. If the movement direction of the carriage 2 is directed leftwardly (S203: NO), the routine proceeds to S208 described later on.

If the reference nozzle 15 is opposed to the portion (downstream side portion) of the image recording area disposed on the downstream side as compared with the center with respect to the sub scanning direction (S201: NO, S202: NO), the routine proceeds as follows. That is, if the movement direction of the carriage 2 is directed rightwardly (S204: YES), the routine proceeds to S208 described later on. If the movement direction of the carriage 2 is directed leftwardly (S204: NO), the routine proceeds to S205 described later on.

In S205, it is judged to which side the alignment direction of the nozzles 15 is inclined with respect to the sub scanning direction. Specifically, it is judged for the inclination with respect to the sub scanning direction whether the nozzles 15 disposed on the upstream side are positioned on either the right side or the left side as compared with the nozzles 15 disposed on the downstream side. That is, it is judged whether the nozzles 15 disposed on the upstream side are positioned on either the right side or the left side with respect to the nozzles 15 disposed on the downstream side, as compared with the case in which the alignment direction of the nozzles 15 is parallel to the sub scanning direction.

If the inclination is provided with respect to the sub scanning direction so that the nozzles 15 disposed on the upstream side are positioned on the right side as compared with the nozzles 15 disposed on the downstream side (S205: YES), then the discharge timing for discharging the ink from the nozzles 15 is set to the present discharge timing, i.e., the timing which is delayed from the reference timing, and the routine proceeds to S105 (S206).

On the other hand, if the alignment direction of the nozzles 15 is inclined with respect to the sub scanning direction so that the nozzles 15 disposed on the upstream side are positioned on the left side as compared with the nozzles 15 disposed on the downstream side (S205: NO), then the discharge timing for discharging the ink from the nozzles 15 is set to the present discharge timing, i.e., the timing which is advanced from the reference timing (S207), and the routine proceeds to S105.

Also in S208, it is judged to which side the alignment direction of the nozzles 15 is inclined with respect to the sub scanning direction, in the same manner as in S205. If the inclination is provided with respect to the sub scanning direction so that the nozzles 15 disposed on the upstream side are positioned on the right side as compared with the nozzles 15 disposed on the downstream side (S208: YES), then the discharge timing for discharging the ink from the nozzles 15 is set to the present discharge timing, i.e., the timing which is advanced from the reference timing (S209), and the routine proceeds to S105.

On the other hand, if the alignment direction of the nozzles 15 is inclined with respect to the sub scanning direction so that the nozzles 15 disposed on the upstream side are positioned on the left side as compared with the nozzles 15 disposed on the downstream side (S208: NO), then the discharge timing for discharging the ink from the nozzles 15 is set to the present discharge timing, i.e., the timing which is delayed from the reference timing (S210), and the routine proceeds to S105.

The degree of delay of the discharge timing for discharging the ink in S206 and S210 and the degree of advance of the discharge timing for discharging the ink in S207 and S209 will be explained in detail later on.

In S105, it is judged whether or not the transport direction of the recording paper P is inclined with respect to the sub scanning direction. If the transport direction of the recording paper P is parallel to the sub scanning direction (S105: NO), the routine proceeds to S107 described later on. In other words, the correction amount of the discharge timing for discharging the ink from the plurality of nozzles 15 based on the inclination of the transport direction of the recording paper P is zero. If the transport direction of the recording paper P is inclined with respect to the sub scanning direction (S105: YES), the routine proceeds to S107 after performing the second correction control explained below (S106).

Figure 5A:
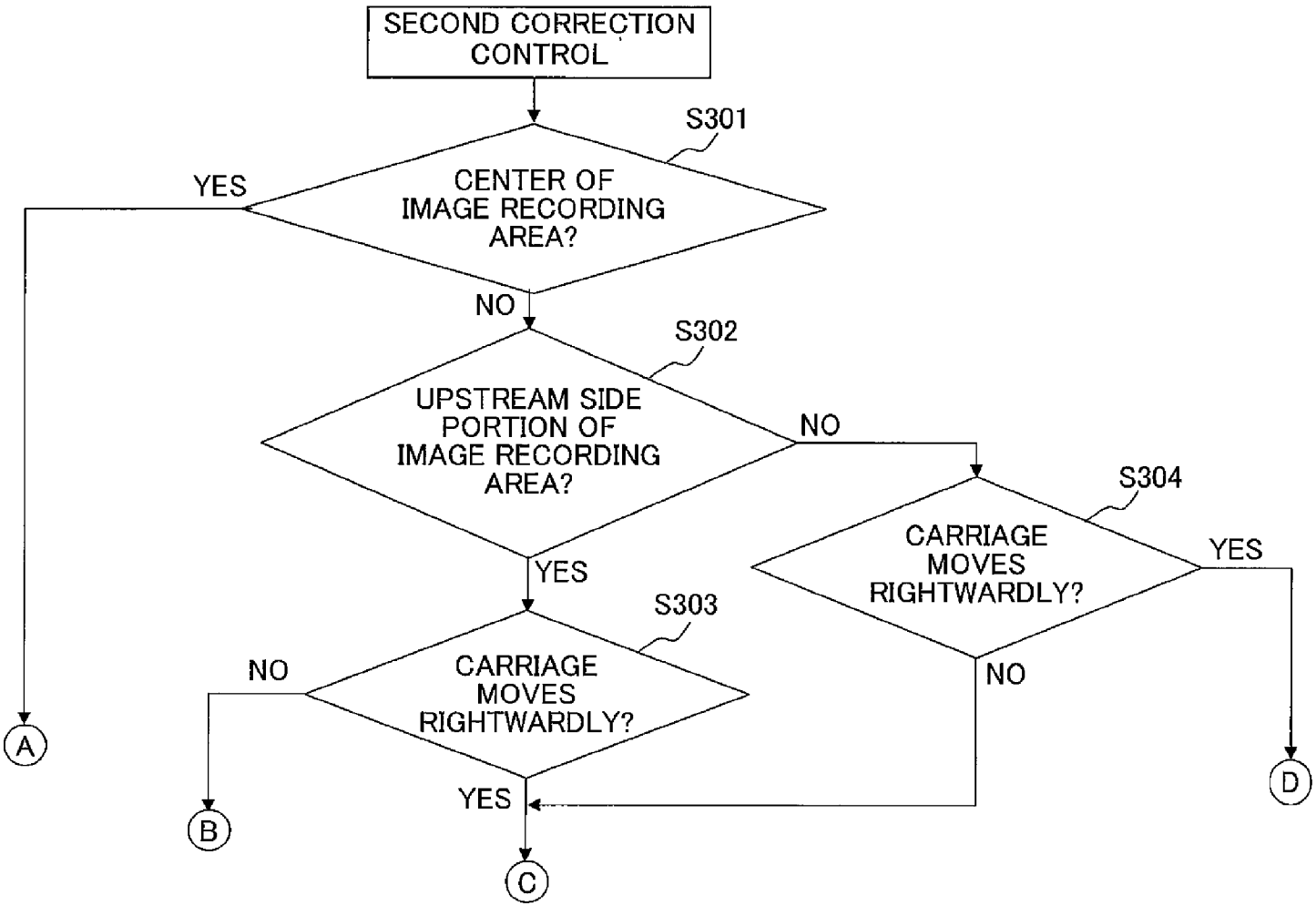
FIGS. 5A and 5B show a flow chart illustrating the flow of the second correction control shown in FIG. 3.
Figure 5B:
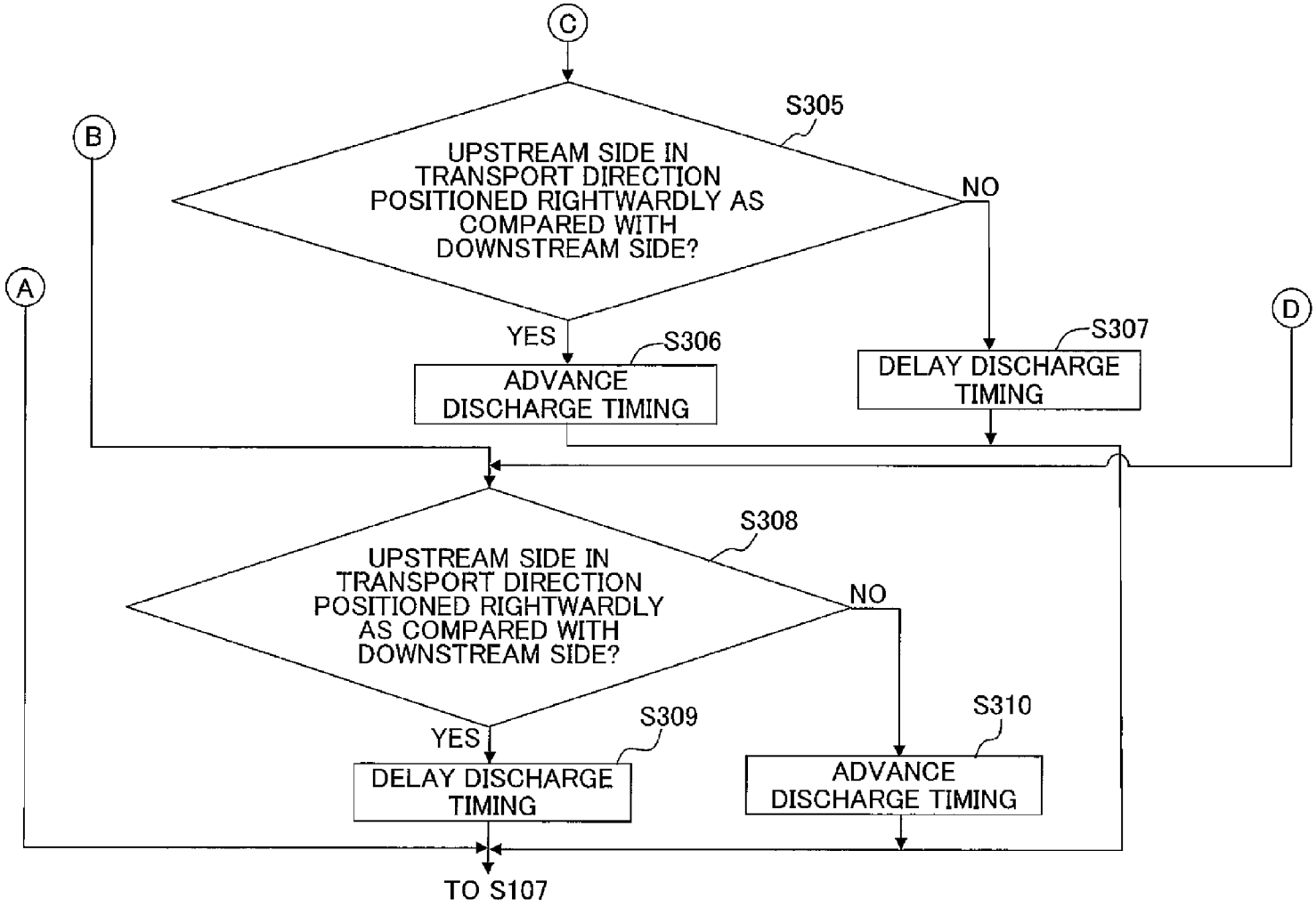

In the second correction control, as shown in FIG. 5, it is judged whether or not the reference nozzle 15, which is formed, for example, at the center in the alignment direction and which is included in the nozzles belonging to each of the nozzle rows 14 of the ink-jet head 3, is opposed to the center of the image recording area for recording the image thereon with respect to the sub scanning direction (S301). Specifically, when the information, which relates to the center of the image recording area (namely, the center of the image) with respect to the sub scanning direction, is inputted together with the image data from the external apparatus such as PC 100 or the like, the correction amount determining section 55 judges whether or not the position of the reference nozzle 15 in the sub scanning direction is coincident with the center of the image recording area in the sub scanning direction. If the reference nozzle 15 is opposed to the center of the image recording area in relation to the sub scanning direction (S301: YES), the routine proceeds to S107 as it is, without performing the correction of the discharge timing as explained below.

On the other hand, if the reference nozzle 15 is opposed to the portion (upstream side portion) of the image recording area disposed on the upstream side as compared with the center in relation to the sub scanning direction (S301: NO, S302: YES), the routine proceeds as follows. That is, if the movement direction of the carriage 2 is directed rightwardly (S303: YES), the routine proceeds to S305 described later on. If the movement direction of the carriage 2 is directed leftwardly (S303: NO), the routine proceeds to S308 described later on.

If the reference nozzle 15 is opposed to the portion (downstream side portion) of the image recording area disposed on the downstream side as compared with the center in relation to the sub scanning direction (S301: NO, S302: NO), the routine proceeds as follows. That is, if the movement direction of the carriage 2 is directed rightwardly (S304: YES), the routine proceeds to S308 described later on. If the movement direction of the carriage 2 is directed leftwardly (S304: NO), the routine proceeds to S305 described later on.

In S305, it is judged to which side the transport direction of the recording paper P is inclined with respect to the sub scanning direction, in the same manner as in S205 and S208. If the transport direction of the recording paper P is inclined with respect to the sub scanning direction so that the upstream side is positioned on the right side as compared with the downstream side (S305: YES), then the discharge timing for discharging the ink from the nozzles 15 is set to the timing which is advanced as compared with the present discharge timing (S306), and the routine proceeds to S107. On the other hand, if the transport direction of the recording paper P is inclined, with respect to the sub scanning direction so that the upstream side is positioned on the left side as compared with the downstream side (S305: NO), then the discharge timing for discharging the ink from the nozzles 15 is set to the timing which is delayed as compared with the present discharge timing (S307), and the routine proceeds to S107.

In S308, it is judged to which side the transport direction of the recording paper P is inclined with respect to the sub scanning direction, in the same manner as in S205, S208, and S305. If the transport direction of the recording paper P is inclined with respect to the sub scanning direction so that the upstream side is positioned on the right side as compared with the downstream side (S308: YES), then the discharge timing for discharging the ink from the nozzles 15 is set to the timing which is delayed as compared with the present discharge timing (S309), and the routine proceeds to S107. On the other hand, if the transport direction of the recording paper P is inclined with respect to the sub scanning direction so that the upstream side is positioned on the left side as compared with the downstream side (S308: NO), then the discharge timing for discharging the ink from the nozzles 15 is set to the timing which is advanced as compared with the present discharge timing (S310), and the routine proceeds to S107.

The present discharge timing, which is referred to in S306, S307, S309, and S310, herein means the reference timing if the first correction control is not performed. The present discharge timing herein means the discharge timing obtained after the correction performed in accordance with the first correction control, if the first correction control is performed. The degree of advance of the discharge timing in S306 and S310 and the degree of delay of the discharge timing in S307 and S309 will be explained in detail later on.

In S107, it is judged whether the recording of the image on the recording paper P is the borderless recording or the bordered recording. If the recording is the borderless recording (S107: YES), the routine proceeds to S111. If the recording is the bordered recording (S107: NO), the routine proceeds to S108. The borderless recording herein means the execution of the recording of the image without any blank space or margin on the recording paper P by discharging the ink or inks from the ink-jet head 3 also to the areas disposed outside the recording paper P in relation to the main scanning direction. The bordered recording herein means the execution of the recording of the image having the blank spaces on the both sides in relation to the main scanning direction of the image recorded on the recording paper P by discharging the ink or inks from the ink-jet head 3 within a range narrower than a range in which the recording paper P is arranged in relation to the main scanning direction. In the case of the ink-jet printer 1, it is possible to selectively perform any one of the borderless recording and the bordered recording.

In S108, it is judged whether or not an angle γ, which is formed by the alignment direction of the nozzles 15 and the transport direction of the recording paper P, is larger than a predetermined angle γ1. If the angle γ is larger than the predetermined angle γ1 (S108: YES), the routine proceeds to S110 described later on. If the angle γ is not more than the predetermined angle γ1 (S108: NO), the routine proceeds to S109 explained below.

In S109, it is judged whether or not the length L of the image recording area in relation to the sub scanning direction is longer than a predetermined length L1. In this procedure, the predetermined length L1 is set to the length as follows. That is, for example, if the recording paper P is the recording paper of A3 size, the length L is longer than the predetermined length L1. For example, if the recording paper P is the recording paper of A4 size or the recording paper smaller than the above, the length L is not more than the predetermined length L1. If the length L is longer than the predetermined length L1 (S109: YES), the routine proceeds to S110 described later on. If the length L is not more than the predetermined length L1 (S109: NO), the routine proceeds to S111 described later on.

In S110, the correction amount of the discharge timing is made smaller than the present correction amount, and the routine proceeds to S111. Specifically, the amount by which the discharge timing is delayed or the amount by which the discharge timing is advanced is made smaller than the preset amount, if the discharge timing for discharging the ink is the timing which is delayed as compared with the reference timing or the timing which is advanced as compared with the reference timing, by means of at least any one of the first correction control (S104) and the second correction control (S107) described above.

In S111, the ink is discharged from the nozzles 15 at the discharge timing determined in S101 to S110, and thus the ink is landed on the area of the recording paper P opposed to the ink-jet head 3. S101 to S111 described, above are repeated (S112: NO) until the recording of the image is completed. If the recording of the image is completed (S112: YES), then the recording paper P is discharged by the recording paper transport roller 4 (S113), and the operation is completed.

Next, an explanation will be made about the image to be recorded on the recording paper P by means of the inkjet printer 1. In this procedure, one image is actually recorded on the recording paper P by performing the scanning a large number of times. However, this procedure is simplified in the following description. An explanation will be made about an exemplary case in which the image is recorded on the recording paper of A4 size by landing the ink or inks successively to five portions R1 to R5 for constructing the image recording area R aligned in the sub scanning direction of the recording paper P by means of the scanning performed five times as shown in FIG. 6. In this case, the image is recorded on the portions R1 to R5 in an order starting from the portion disposed on the downstream side in the transport direction (order of the portions R5, R4, R3, R2, R1).

This example is illustrative of such a case that the center in relation to the sub scanning direction of the portion R3 included in the five portions R1 to R5 is coincident with the center C of the image recording area R in relation to the sub scanning direction, and the reference nozzle 15 is opposed to the center of the portion R3 in relation to the sub scanning direction when the ink is discharged to the portion R3.

Figure 6A:
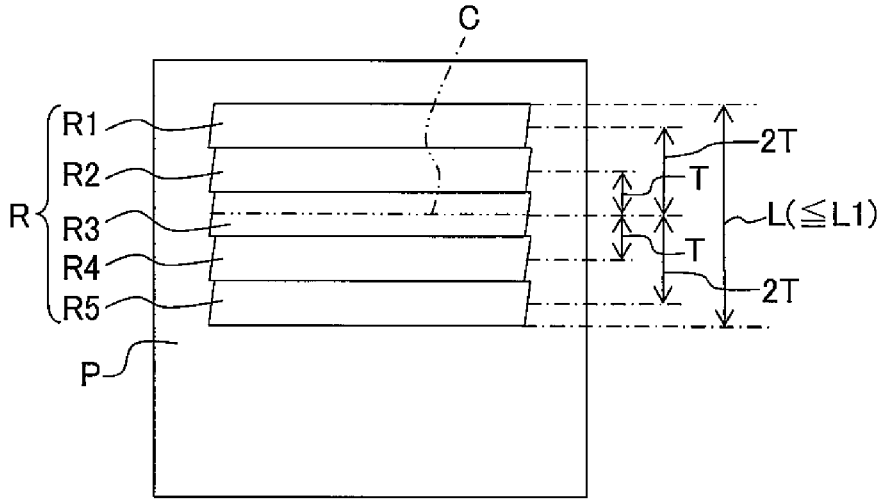
FIG. 6A shows an image recorded when the nozzle alignment direction is inclined and the discharge timing is not corrected.
Figure 6B:
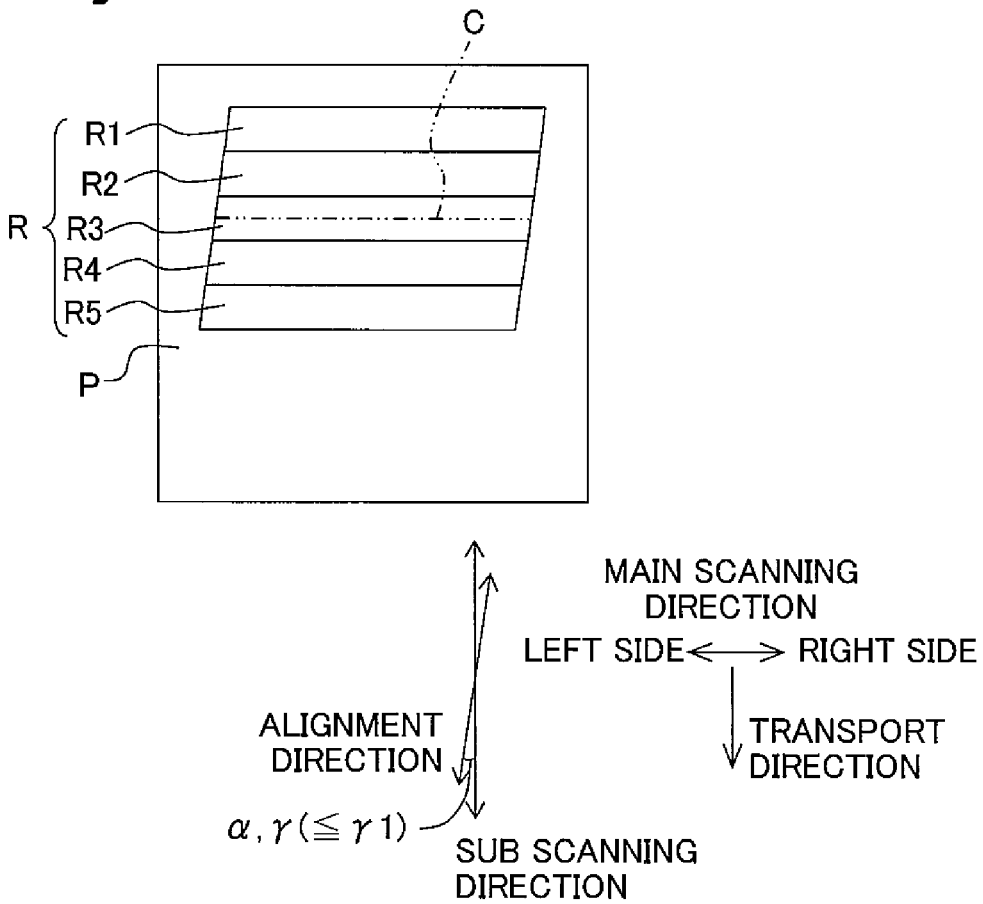
FIG. 6B shows an image recorded when the nozzle alignment direction is inclined and the discharge timing is corrected.

In the examples shown in FIGS. 6A and 6B, the alignment direction of the nozzles 15 is inclined by an angle α with respect to the sub scanning direction so that the nozzles 15 disposed on the upstream side are positioned on the right side (one side) as compared with the nozzles 15 disposed on the downstream side, and the transport direction of the recording paper P is parallel to the sub scanning direction. Therefore, in the situation as described above, the discharge timing is corrected by means of only the first correction control described above.

It is provisionally assumed that the first correction control is not performed. On this assumption, the landing position of the ink discharged in certain scanning from the nozzle 15 positioned at the end on the upstream side in the transport direction is deviated by T tan α in the main scanning direction front the landing position of the ink discharged in the next scanning from the nozzle 15 positioned at the end on the downstream side in the transport direction. Accordingly, as shown in FIG. 6A, the end on the downstream side in relation to the transport direction of the portion formed by the ink landed on each of the portions R1 to R4 is deviated in the main scanning direction from the end on the upstream side in relation to the transport direction of the portion formed by the ink landed on each of the portions R2 to R5 positioned nearby on the downstream side from each of the portions R1 to R4, in the image recorded on the recording paper P. The image quality of the recorded image is deteriorated.

In the contrary, in the embodiment of the present teaching, the ink is discharged at the reference timing described above for the portion R3 of the portions R1 to R5 by means of the first correction control as shown in FIG. 6B. As for the portions R1, R2, the discharge timing for discharging the ink is advanced or delayed as compared with the reference timing. Accordingly, assuming that D represents the distance from the portion R3 in relation to the sub scanning direction, the ink is landed at the position deviated to the right side (one side) by D tan α from the reference landing position. Specifically, the timing is advanced or delayed as compared with the reference timing by an amount of time obtained by dividing D tan α by the movement velocity of the carriage 2 in the main scanning direction. As for the portions R4, R5, the discharge timing for discharging the ink is advanced or delayed as compared with the reference timing. Accordingly, the ink is landed at the position deviated to the left side (opposite side opposite to one side) by D tan α from the reference landing position. Specifically, the timing is advanced or delayed as compared with the reference timing by an amount of time obtained by dividing D tan α by the movement velocity of the carriage 2 in the main scanning direction. In this embodiment, the amount, which is calculated with D tan α, corresponds to the predetermined deviation amount according to the present teaching. The values of D are 2T for the portions R1, R5 and T for the portions R2, R4.

Accordingly, the deviation disappears among the portions R1 to R5 as described above in the recorded image. The image quality of the recorded image is improved.

Further, as for the portion R3 which is the central portion in relation to the sub scanning direction and which is included in the image recording area R, the ink droplets are landed at the reference landing positions by discharging the ink droplets at the reference timing. Therefore, the ink droplets are landed on the substantially central portion of the recording paper P in relation to the main scanning direction. As for the portions R1, R2 which are the upstream side portions and the portions R4, R5 which are the downstream side portions, the ink droplets are landed at the positions deviated to the mutually opposite sides in relation to the main scanning direction from the reference landing positions. Therefore, it is possible to decrease the difference in the length in relation to the main scanning direction between the blank spaces or margins disposed on the both sides in relation to the main scanning direction of the respective portions R1 to R5 of the recording paper P, for example, as compared with the case in which the ink droplets are landed at the reference landing positions on the portion R5 for firstly recording the image and the ink landing positions are deviated to the right side on the portions R1 to R4 disposed on the upstream side in the transport direction as compared with the portion R5, in accordance with the same or equivalent control as that described in Japanese Patent Application Laid-open No. 2008-254303.

Figure 7A:
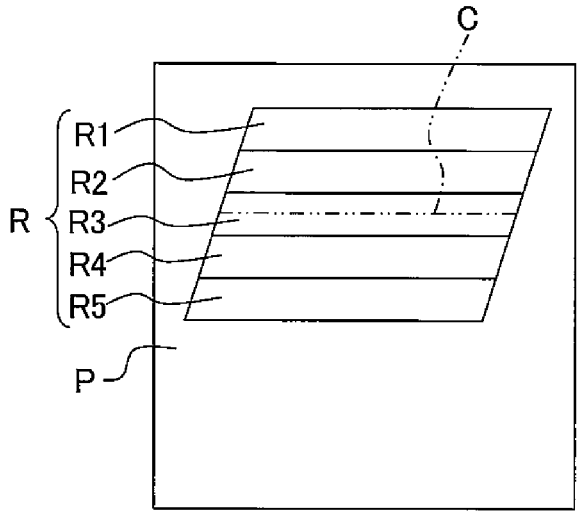
FIG. 7A shows an image recorded when the nozzle alignment direction is greatly inclined and the ink landing position is deviated by a predetermined amount.
Figure 7B:
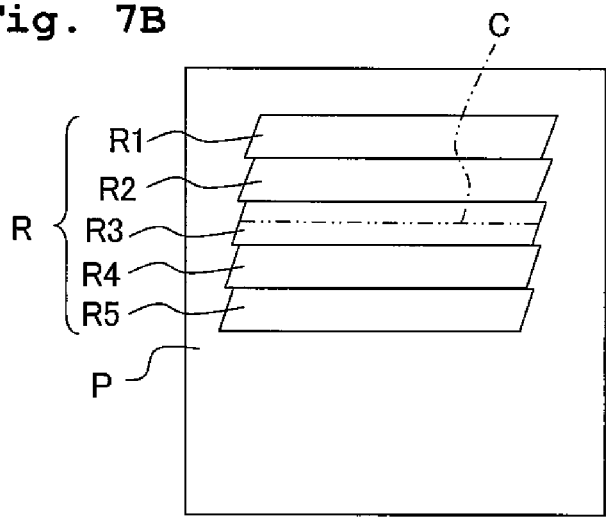
FIG. 7B shows an image recorded when the nozzle alignment direction is greatly inclined and the ink landing position is deviated by an amount smaller than the predetermined amount.
Figure 7B:
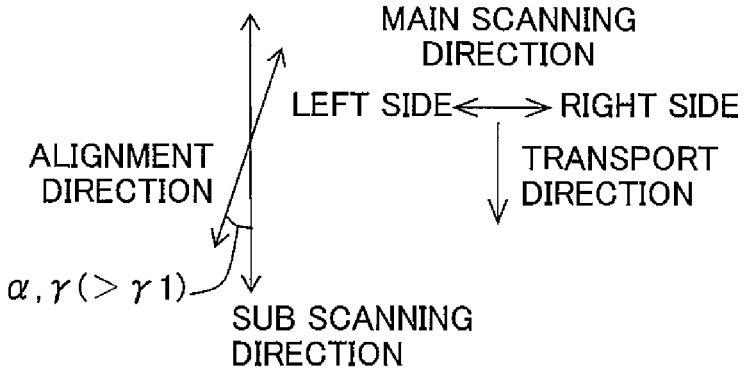

As another example, as shown in FIGS. 7A and 7B, an explanation will be made about a case wherein the angle $\gamma$ (equal to $\alpha$ on account of the transport direction parallel to the sub scanning direction), which is formed by the alignment direction of the nozzles 15 and the transport direction of the recording paper P, is greater than the predetermined angle $\gamma$1. This example is also illustrative of such a case that the center in relation to the sub scanning direction of the portion R3 included in the five portions R1 to R5 is coincident with the center C of the image recording area R with respect to the sub scanning direction, and the reference nozzle 15 is opposed to the center of the portion R3 with respect to the sub scanning direction when the ink is discharged to the portion R3. In this case, as described above, if the ink droplets are landed at the reference landing positions on the portion R3 by discharging the ink droplets at the reference timing, and the ink droplets are landed at the positions deviated by the predetermined deviation amount on the portions R1, R2, R4, R5, then the difference in the lengths between the blank spaces is increased at the upstream side portion and the downstream side portion as shown in FIG. 7A.

In view of the above, in this embodiment, if the angle $\gamma$ ($=\alpha$), which is formed by the alignment direction of the nozzles 15 and the transport direction of the recording paper P, is larger than the predetermined angle $\gamma$1, the amount, by which the ink landing position is deviated, is made smaller than the predetermined deviation amount. Accordingly, as shown in FIG. 7B, it is possible to decrease the difference in the length between the blank spaces described above, although the deviation more or less remains among the portions R1 to R5.

Figure 8A:
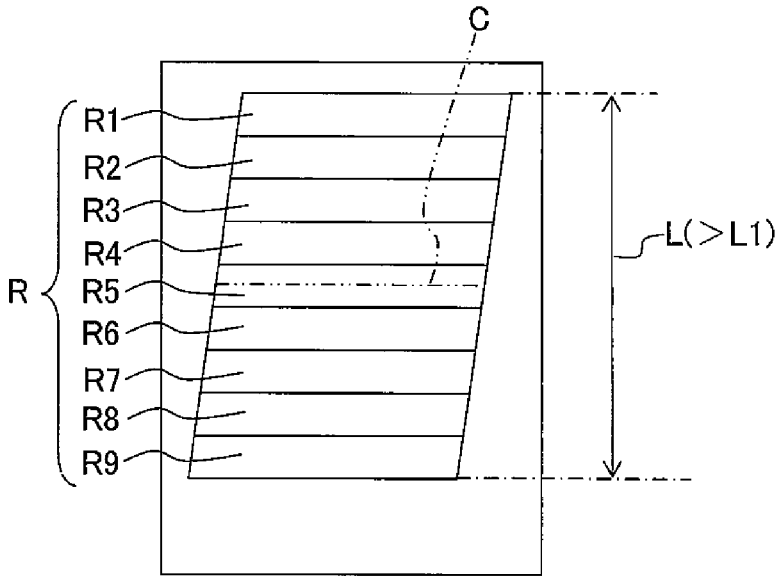
FIG. 8A shows an image recorded when the nozzle alignment direction is inclined, the recording paper is long in the sub scanning direction, and the ink landing position is deviated by a predetermined amount.
Figure 8B:
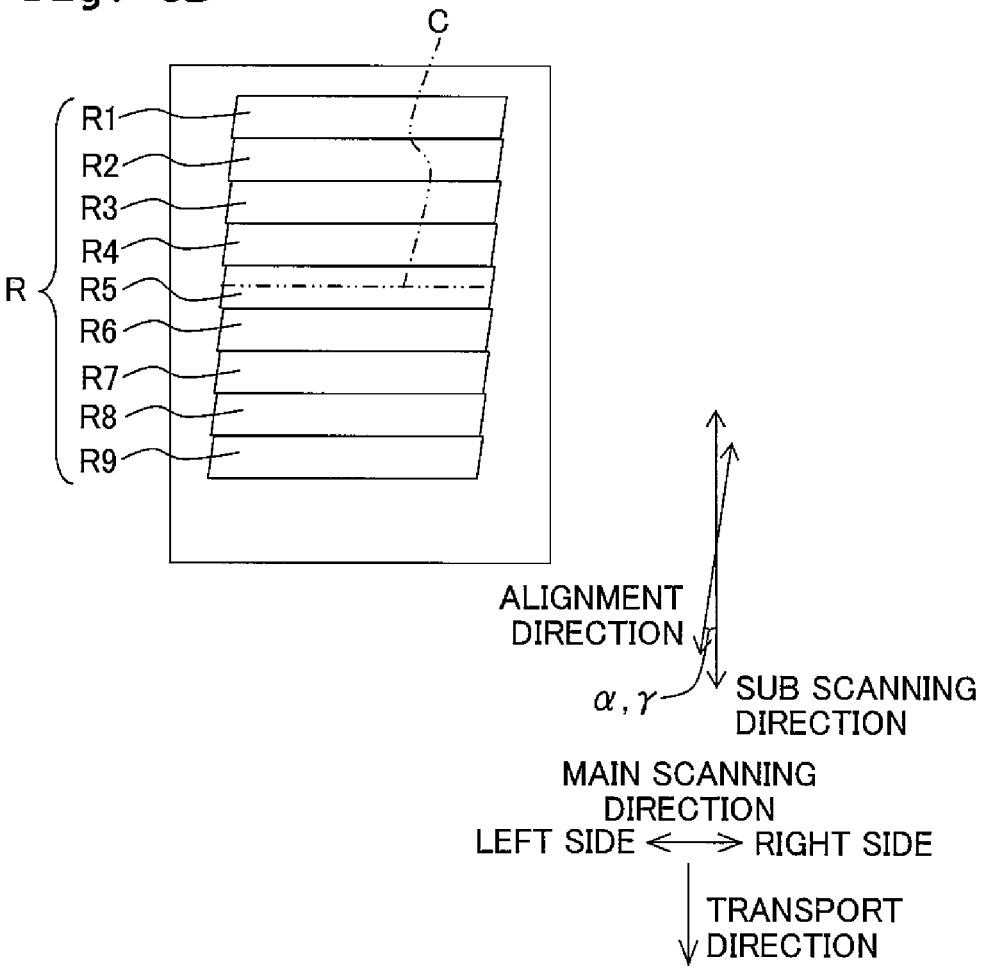
FIG. 8B shows an image recorded when the nozzle alignment direction is inclined, the recording paper is long in the sub scanning direction, and the ink landing position is deviated by an amount smaller than the predetermined amount.

As still another example, as shown in FIGS. 8A and 8B, an explanation will be made about a case wherein an image is recorded on the recording paper of A3 size, i.e., an example wherein the length L of the image recording area in relation to the sub scanning direction is longer than the predetermined length L1 and an image is recorded by landing the ink droplets, for example, onto nine portions R1 to R9. This example is illustrative of such a case that the center with respect to the sub scanning direction of the portion R5 of the nine portions R1 to R9 is coincident with the center C of the image recording area R with respect to the sub scanning direction, and the reference nozzle 15 is opposed to the center of the portion R5 with respect to the sub scanning direction when the ink droplets are discharged to the portion R5. In the situation as described above, even when the angle $\alpha$ of the alignment direction of the nozzles 15 with respect to the sub scanning direction is small, if the ink droplets are landed at the reference landing positions on the portion R5 by discharging the ink droplets at the reference timing, and the ink droplets are landed at the positions deviated by the predetermined deviation amount on the portions R1 to R4, R6 to R9 in the same manner as described above, then the difference in the lengths between the blank spaces is increased at the portions (for example, the portions R1, R9) which are greatly separated from the portion R5 in the sub scanning direction as shown in FIG. 8A.

In view of the above, in this embodiment, if the length L is longer than the predetermined length L1, the amount, by which the ink landing position is deviated, is made smaller than the predetermined deviation amount. Accordingly, as shown in FIG. 8B, it is possible to decrease the difference in the length between the blank spaces described above, although the deviation more or less remains among the portions R1 to R9.

In this embodiment, the recording of the image, which is performed for the image recording area R having the length L that is longer than the predetermined length L1 and which is exemplified, for example, by the recording of the image on the recording paper of A3 size, corresponds to the long area recording according to the present teaching. On the other hand, the recording of the image, which is performed for the image recording area R having the length L that is not more than the predetermined length L1 and which is exemplified, for example, by the recording of the image on the recording paper of A4 size, corresponds to the short area recording according to the present teaching.

Figure 9:
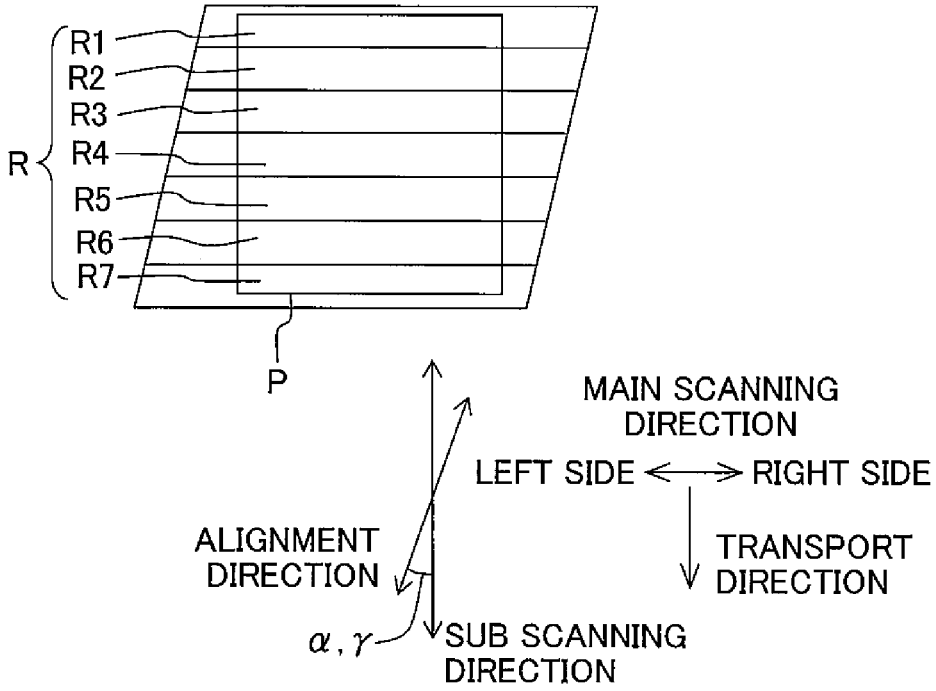
FIG. 9 shows the borderless recording.

In still another example, as shown in FIG. 9, an explanation will be made about the example in which the borderless recording is performed. In the case of the bordered recording as performed in the examples shown in FIGS. 6A to 8B, as described above, the difference in the length between the blank spaces in relation to the main scanning direction causes the problem. Therefore, if the angle $\gamma(=\alpha)$ is larger than the predetermined angle $\gamma$1, or if the length L is longer than the predetermined length L1, then the amount, by which the landing position is deviated, is made smaller than the predetermined deviation amount. However, in the case of the borderless recording shown in FIG. 9, the blank spaces are not formed on the both sides in relation to the main scanning direction of the image recorded on the recording paper P. Therefore, the difference in the length between the blank spaces as described above causes no problem. Therefore, in the case of the borderless recording, the amount, by which the landing position is deviated, is the predetermined deviation amount irrelevant to the angle $\alpha$ and the length L. Accordingly, it is possible to reliably improve the image quality of the recorded image.

Figure 10A:
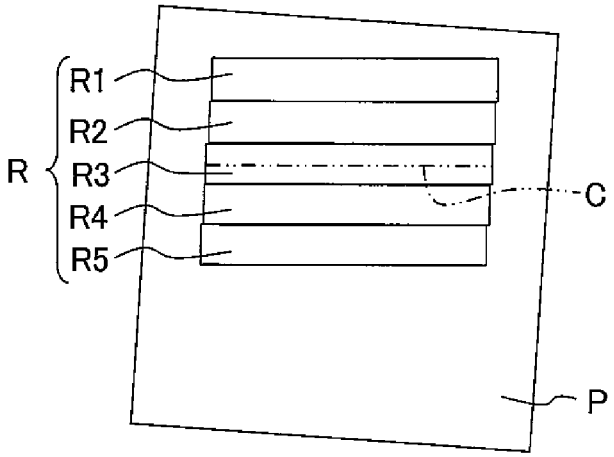
FIG. 10. A shows an image recorded when the transport direction of the recording paper is inclined and the discharge timing is not corrected.
FIG. 10B shows an image recorded when the transport direction of the recording paper is inclined and the discharge timing is corrected.
Figure 10B:
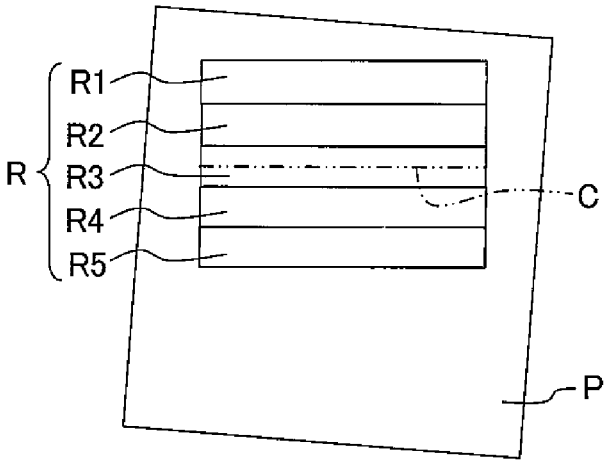
Figure 10B:
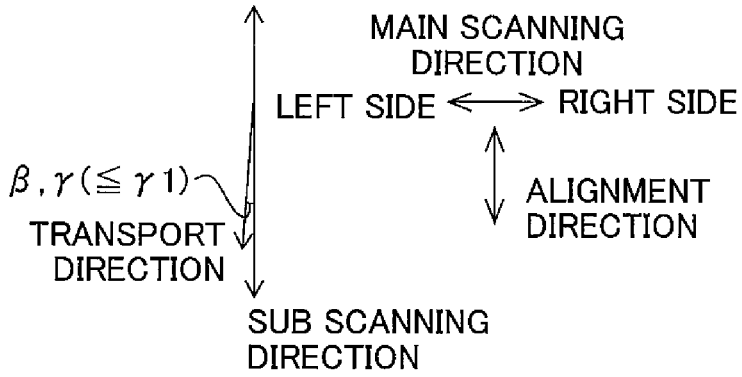

In still another example, for example, as shown in FIGS. 10A and 10B, an explanation will be made about the example wherein the transport direction is inclined by an angle $\beta$ with respect to the sub scanning direction so that the upstream side is positioned on the right side (one side) as compared with the downstream side, and the alignment direction of the nozzles 15 is parallel to the sub scanning direction. This example is illustrative of such a case that the center in relation to the sub scanning direction of the portion R3 of the five portions R1 to 85 is coincident with the center C of the image recording area R in relation to the sub scanning direction, and the reference nozzle 15 is opposed to the center of the portion R3 in relation to the sub scanning direction when the ink droplets are discharged to the portion R3. In this case, the discharge timing is corrected by means of only the second correction control described above.

It is provisionally assumed that the second correction control is not performed. On this assumption, the landing position of the ink discharged in certain scanning from the nozzle 15 positioned at the end on the upstream side in the transport direction is deviated by T tan $\beta$ in the main scanning direction from the landing position of the ink discharged in the next scanning from the nozzle 15 positioned at the end on the downstream side in the transport direction. Accordingly, as shown in FIG. 10A, the end on the downstream side in relation to the transport direction of the portion formed by the ink landed on each of the portions R1 to R4 is deviated in the main scanning direction from the end on the upstream side in relation to the transport direction of the portion formed by the ink landed on each of the portions R2 to R5 positioned nearby on the downstream side from each of the portions R1 to R4 in the image recorded on the recording paper P. The image quality of the recorded image is deteriorated.

On the contrary, in the embodiment of the present teaching, as shown in FIG. 10B, the ink is landed at the reference landing position described above on the portion R3, and the ink is landed at the position deviated to the left side (opposite side opposite to one side) by D tan β from the reference landing position on each of the portions R1, R2 in accordance with the second correction control. The ink, which is landed on each of the portions R4, R5, is landed at the position deviated to the right side (one side) by D tan β from the reference landing position. In this case, D tan β corresponds to the predetermined deviation amount according to the present teaching.

Accordingly, the deviation disappears among the portions R1 to R5 as described above in the recorded image. The image quality of the recorded image is improved.

Further, as for the portion R3 which is the central portion in relation to the sub scanning direction and which is included in the image recording area R, the ink droplets are landed at the reference landing position by discharging the ink droplets at the reference timing. Therefore, the ink droplets are landed on the substantially central portion of the recording paper P in relation to the main scanning direction. As for the portions R1, R2 which are the upstream side portions and the portions R4, R5 which are the downstream side portions, the ink droplets are landed at the positions deviated to the mutually opposite sides in relation to the main scanning direction from the reference landing positions. Therefore, it is possible to decrease the difference in the lengths in relation to the main scanning direction between the blank spaces or margins on the both sides in relation to the main scanning direction of each of the portions R1 to R5 of the recording paper P, for example, as compared with the case in which the ink droplets are landed at the reference landing positions on the portion R5 for firstly recording the image thereon and the ink landing positions are deviated to the left side on each of the portions R1 to R4 disposed on the upstream side in the transport direction as compared with the portion R5, in accordance with the same or equivalent control as that described in Japanese Patent Application Laid-open No. 2008-254303.

When the transport direction is inclined with respect to the sub scanning direction, the operation is also performed as follows. That is, if the bordered recording is performed, then the amount of deviation of the landing position is decreased as compared with the predetermined deviation amount described above, if the angle γ (equal to β on account of the alignment direction of the nozzles parallel to the sub scanning direction), which is formed by the alignment direction of the nozzles 15 and the transport direction, is larger than the predetermined angle γ1, or if the length L is larger than the predetermined length L1. If the borderless recording is performed, the ink landing position is deviated by the predetermined deviation amount, irrelevant to the angle γ and the length L.

If the alignment direction of the nozzles 15 is inclined so that the nozzles 15 disposed on the upstream side are positioned on the left side as compared with the nozzles disposed on the downstream side, or if the transport direction is inclined so that the upstream side is positioned on the left side as compared with the downstream side, then the ink landing position is deviated to the side opposite to the side described above.

If both of the alignment direction of the nozzles 15 and the transport direction are inclined with respect to the sub scanning direction, the ink landing position is deviated by the same amount as that provided when only the transport direction is inclined with respect to the sub scanning direction, from the ink landing position provided when only the alignment direction of the nozzles 15 is inclined with respect to the sub scanning direction. Also in this case, if the bordered recording is performed, then the amount of deviation of the landing position is made smaller than the predetermined deviation amount described above, if the angle γ (equal to α+β if the alignment direction of the nozzles 15 and the transport direction are inclined to the mutually opposite sides, or equal to α−β if the alignment direction of the nozzles 15 and the transport direction are inclined to the same side) is larger than the predetermined angle γ or if the length L is longer than the predetermined length L1, if the borderless recording is performed, the ink landing position is deviated by the predetermined deviation amount, irrelevant to the angle γ and the length L.

Next, an explanation will be made about modified embodiments in which various changes or modifications are applied to the embodiment of the present teaching. However, the components or parts, which are constructed in the same manner as those of the embodiment of the present teaching, are appropriately omitted from the explanation.

In the embodiment of the present teaching, the nozzle, which is formed at the center in the alignment direction and which is included in the nozzles belonging to each of the nozzle rows 14 of the ink-jet head 3, is designated as the reference nozzle 15. However, any nozzle 15 may be designated as the reference nozzle 15, provided that the nozzle 15 is included in each of the nozzle rows 14.

Figure 11:
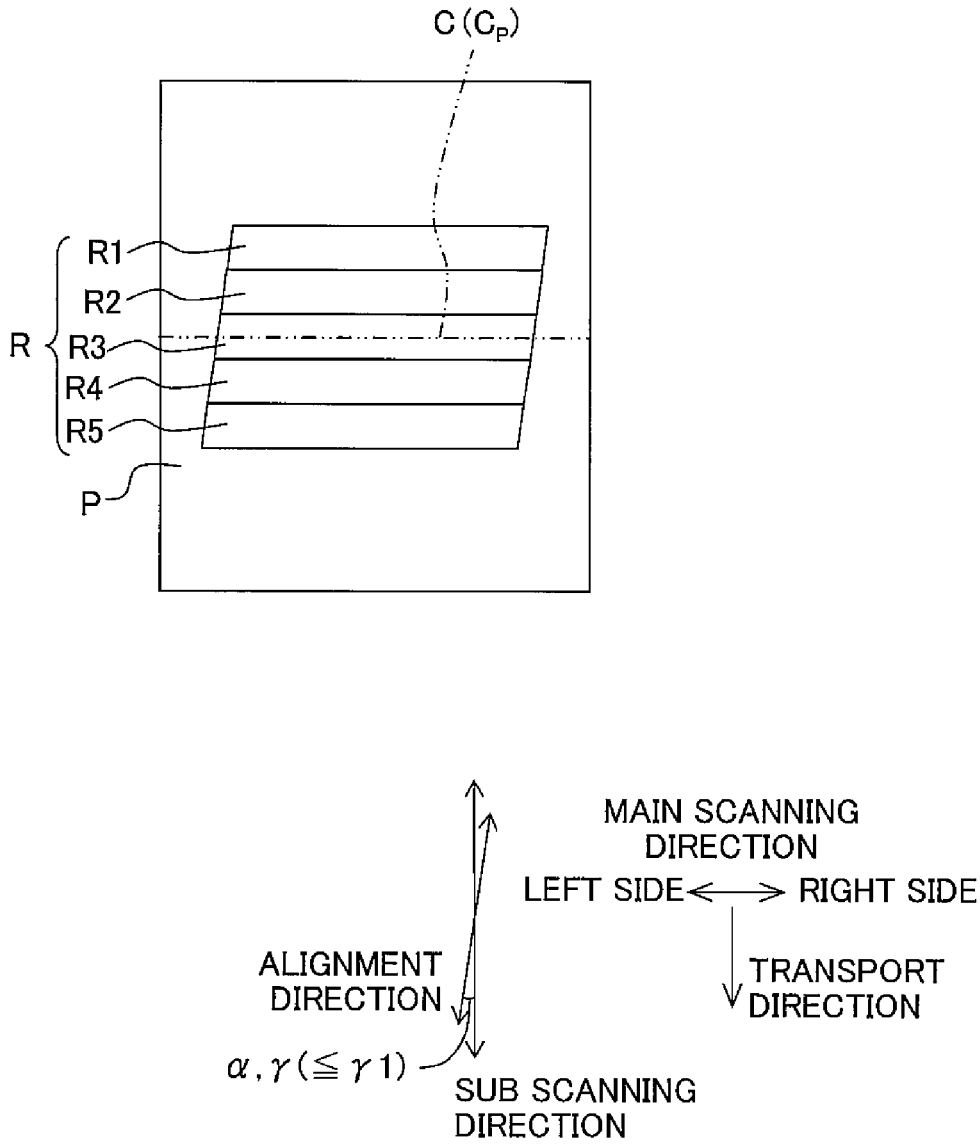
FIG. 11 shows an example in which the center of the image recording area in relation to the sub scanning direction is coincident with the center of the recording paper in relation to the sub scanning direction.

In the embodiment of the present teaching, it is judged in the first correction control and the second correction control whether or not the reference nozzle 15 is opposed to the center in relation to the sub scanning direction of the image recording area for recording the image thereon (S201, S301). However, there is no limitation thereto. For example, as shown in FIG. 11, if the center C in relation to the sub scanning direction of the image recording area is coincident with the center $C_P$ in relation to the sub scanning direction of the recording paper, it is also allowable to judge whether or not the reference nozzle 15 is opposed to the center $C_P$ in relation to the sub scanning direction of the recording paper.

In the embodiment of the present teaching, it is judged whether the amount of deviation of the landing position is the predetermined deviation amount or the amount smaller than the predetermined deviation amount, depending on whether or not the recording is the borderless recording, whether or not the angle γ is larger than the predetermined angle γ1, and whether or not the length L is longer than the predetermined length L1. However, it is also allowable to judge whether the amount of deviation of the landing position is the predetermined deviation amount or the amount smaller than the predetermined deviation amount, depending on one or two of the three conditions described above.

Further, the present teaching is not limited to the determination of whether the amount of deviation of the ink landing position is the predetermined deviation amount or the amount smaller than the predetermined deviation amount, depending on the conditions as described above as well. That is, the ink landing positions of the upstream side portion and the downstream side portion may be always deviated by the predetermined deviation amount irrelevant to the conditions as described, above.

In the embodiment of the present teaching, the ink or inks is/are discharged from the nozzles 15 when the carriage 2 is moved in any one of the directions directed to the right side and the left side. However, there is no limitation thereto. The ink or inks may be discharged from the nozzles 15 only when the carriage 2 is moved to the right side or only when the carriage 2 is moved to the left side.

In the embodiment of the present teaching, the ink-jet printer 1 can perform both of the first correction control and the second correction control. However, there is no limitation thereto. That is, it is also allowable that the ink-jet printer 1 can perform only any one of the first correction control and the second correction control.

In the embodiment of the present teaching, one image recording area R, which extends over the substantially entire region of the recording paper P, exists on the recording paper P. However, there is no limitation thereto. For example, a plurality of image recording areas may exist on the recording paper P. In this case, for example, the image may be recorded on each of the image recording areas in accordance with the same or equivalent control as that described above.

In the embodiment of the present teaching, the information which relates to the center of the image recording area with respect to the sub scanning direction is inputted together with the image data from the external apparatus such as PC 100 or the like. However, there is no limitation thereto. For example, it is also allowable that the controller 50 calculates to obtain the information which relates to the center of the image recording area with respect to the sub scanning direction when the image data is inputted from the external apparatus such as PC 100 or the like.

In the embodiment, the long area recording is exemplified by the recording of the image on the recording paper of A3 size and the short are recording is exemplified by the recording of the image on the recording paper of A4 size. However, there is no limitation thereto. For example, the long area recording may be exemplified by recording of the image on the recording paper of A4 size, and the short area recording may be exemplified by recording of the image on the recording paper of B5 size. Alternatively, the long area recording may be exemplified by recording of the image on the recording paper of A4 size which is transported in a long direction thereof, and the short area recording may be exemplified by recording of the image on the recording paper of A4 size which is transported in a short direction thereof.

In the embodiment, after it is judged whether or not the alignment direction of the nozzles 15 is inclined with respect to the sub scanning direction in step S103, it is judged whether or not the transport direction of the recording paper P is inclined with respect to the sub scanning direction in step S105. However, there is no limitation thereto. For example, the inclination of the alignment direction of the nozzles 15 with respect to the sub scanning direction and the inclination of the transport direction of the recording paper P with respect to the sub scanning direction may be judged in parallel. Then, the inclination amount of the alignment direction of the nozzles 15 and the inclination amount of the transport direction of the recording paper P may be combined, and after that, the correction amount of the discharge timing for discharging the ink from the plurality of nozzles 15 may be determined based on the combined inclination amount.

What is claimed is:

1. An ink-jet printer which records an image by discharging ink droplets of an ink onto a recording medium, the ink-jet printer comprising:

an ink-jet head which has an ink discharge surface formed with a nozzle row, the nozzle row being formed by a plurality of nozzles from which the ink droplets are discharged and which are aligned in an alignment direction;

a carriage which carries the ink-jet head thereon and which makes the ink-jet head scan by reciprocating in a main scanning direction parallel to the ink discharge surface;

a transport mechanism which transports the recording medium in a transport direction intersecting the main scanning direction, the ink droplets discharged from the nozzles being landed on the recording medium; and a discharge controller which is configured to control the ink-jet head to discharge the ink droplets from the nozzles, wherein: an image recording area of the recording medium on which the image is to be recorded is formed by a plurality of sub recording areas disposed in the transport direction;

each of the sub recording areas is to be recorded by one scanning operation of the ink-jet head in the main scanning direction;

the nozzle row includes: upstream-side nozzles which are disposed on the upstream side of the nozzle row in the transport direction; and downstream-side nozzles which are disposed on the downstream side of the nozzle row in the transport direction;

the discharge controller is configured to control a discharge timing of the ink droplets so that the ink droplets are discharged from all of the nozzles included in the nozzle row at the same discharge timing in each scanning operation of the ink jet head; and in a case that the alignment direction is inclined with respect to a sub scanning direction perpendicular to the main scanning direction so that the upstream-side nozzles are positioned on one side in the main scanning direction with respect to the downstream-side nozzles, the discharge controller is configured to change the discharge timing of the ink droplets for every scanning operation of the ink-jet head, such that:

under the condition that the scanning operation is performed for a central sub recording area which is included in the sub recording areas and which includes a center of the image recording area in the transport direction, the discharge controller is configured to control the ink-jet head to discharge the ink droplets from all of the nozzles included in the nozzle row at a predetermined reference timing to land the ink droplets on reference landing positions in the main scanning direction;

under the condition that the scanning operation is performed for an upstream-side sub recording area which is included in the sub recording areas and which is disposed on an upstream side in the transport direction as compared with the central sub recording area, the discharge controller is configured to change the discharge timing from the reference timing to deviate the landing positions of the ink droplets to the one side in the main scanning direction with respect to the reference landing positions; and under the condition that the scanning operation is performed for a downstream-side sub recording area which is included in the sub recording areas and which is disposed on a downstream side in the transport direction as compared with the central sub recording area, the discharge controller is configured to change the discharge timing from the reference timing to deviate the landing positions of the ink droplets to the other side in the main scanning direction with respect to the reference landing positions.

2. The ink jet printer according to claim 1, wherein: the discharge controller is configured to control the ink jet head to discharge the ink droplets in a scanning operation of the ink jet head in which the carriage is moved to the one side in the main scanning direction and in a scanning operation of the ink jet head in which the carriage is moved to the other side in the main scanning direction;

in that the scanning operation in which the carriage is moved to the one side in the main scanning direction, the discharge controller is configured to delay the discharge timing as compared with the reference timing under the condition that the scanning operation is performed for the upstream-side sub recording area, and the discharge controller is configured to advance the discharge timing as compared with the reference timing under the condition that the scanning operation is performed for the downstream-side sub recording area; and in that the scanning operation in which the carriage is moved to the other side in the main scanning direction, the discharge controller is configured to advance the discharge timing as compared with the reference timing under the condition that the scanning operation is performed for the upstream-side sub recording area, and the discharge controller is configured to delay the discharge timing as compared with the reference timing under the condition that the scanning operation is performed for the downstream-side sub recording area.

3. The ink jet printer according to claim 1, wherein:

the transport mechanism is configured to transport the recording medium so that the transport direction extends along the sub scanning direction; and in a case that the recording medium is transported in a state in which the transport direction is inclined with respect to the sub scanning direction, the discharge controller is configured to further change the discharge timing from the reference timing depending on an inclination of the transport direction under the condition that the scanning operation is performed for the upstream-side sub recording area and under the condition that the scanning operation is performed for the downstream-side sub recording area, respectively.

4. The ink jet printer according to claim 1, wherein the discharge controller is configured to control the ink jet head to deviate the landing positions of the ink droplets with respect to the reference landing positions by a predetermined deviation amount corresponding to a distance from the central sub recording area and an angle of inclination of the alignment direction with respect to the sub scanning direction under the condition that the scanning operation is performed for the upstream-side sub recording area and under the condition that the scanning operation is performed for the downstream side sub recording area, respectively.

5. The ink-jet printer according to claim 4, wherein: in a case that an angle, which is formed by the alignment direction and the transport direction, is not greater than a predetermined angle, the discharge controller is configured to control the ink jet head to deviate the landing positions of the ink droplets by the predetermined deviation amount under the condition that the scanning operation is performed for the upstream-side sub recording area and under the condition that the scanning operation is performed for the downstream-side sub recording area, respectively; and in a case that the angle, which is formed by the alignment direction and the transport direction, is greater than the predetermined angle, the discharge controller is configured to control the ink jet head to deviate the landing positions of the ink droplets by an amount smaller than the predetermined deviation amount under the condition that the scanning operation is performed for the upstream-side sub recording area and under the condition that the scanning operation is performed for the downstream-side sub recording area, respectively.

6. The ink-jet printer according to claim 4, wherein:

the discharge controller is configured to control the ink jet head to selectively perform anyone of borderless recording, in which the image is recorded on the image recording area extending over an entire length of the recording medium with respect to the main scanning direction by discharging the ink: droplets from the nozzles over a range wider than a range of arrangement of the recording medium with respect to the main scanning direction, and bordered recording, in which the image is recorded on the image recording area having a length with respect to the main scanning direction that is shorter than that the length of the recording medium with respect to the main scanning direction and having blank spaces disposed on both sides with respect to the main scanning direction;

in a case that the borderless recording is performed, the discharge controller is configured to control the ink jet head to deviate the landing positions of the ink droplets by the predetermined deviation amount under the condition that the scanning operation is performed for the upstream-side sub recording area and under the condition that the scanning operation is performed for the downstream-side sub recording area, respectively; and in a case that the bordered recording is performed, the discharge controller is configured to control the ink jet head to deviate the landing positions of the ink droplets by an amount smaller than the predetermined deviation amount under the condition that the scanning operation is performed for the upstream-side sub recording area and under the condition that the scanning operation is performed for the downstream-side sub recording area, respectively.

7. The ink-jet printer according to claim 4, wherein: the discharge controller is configured to control the inkjet head to selectively perform any one of short area recording, in which the image is recorded on the image recording area having a length with respect to the sub scanning direction that is not greater than a predetermined length, and long area recording, in which the image is recorded on the image recording area having a length with respect to the sub scanning direction that is greater than the predetermined length;

in a case that the short area recording is performed, the discharge controller is configured to control the ink jet head to deviate the landing positions of the ink droplets by the predetermined deviation amount under the condition that the scanning operation is performed for the upstream-side sub recording area and under the condition that the scanning operation is performed for the downstream-side sub recording area, respectively; and in a case that the long area recording is performed, the discharge controller is configured to control the ink jet head to deviate the landing positions of the ink droplets by an amount smaller than the predetermined deviation amount under the condition that the reference nozzle is opposed to the upstream side portion and under the condition that the reference nozzle is opposed to the downstream side portion, respectively.

8. The ink-jet printer according to claim 1, wherein the discharge controller is configured to receive an information, which relates to the center of the image recording area with respect to the sub scanning direction, from an external apparatus which is connectable to the ink jet printer.

9. The ink-jet printer according to claim 1, wherein the center of the image recording area with respect to the sub scanning direction is coincident with a center of the recording medium with respect to the sub scanning direction.

10. The ink jet printer according to claim 1, wherein the center of the image recording area with respect to the sub scanning direction is a center of the image with respect to the sub scanning direction.

11. The in-jet printer according to claim 1, wherein the sub recording areas include a first sub recording area and a second sub recording are which is adjacent to the first sub recording area in the transport direction, and under the condition that the scanning operation is performed for each of the first sub recording area and the second sub recording area, the discharge controller is configured to control the discharge timing of the ink droplets to land the ink droplets on the first sub recording area and the second sub recording area such that: one end portion of the first sub recording area on the one side in the main scanning direction and one end portion of the second sub recording area on the one side in the main scanning direction are aligned in the alignment direction; and the other end portion of the first sub recording area on the other side in the main scanning direction and the other end portion of the second sub recording area on the other side in the main scanning direction are aligned in the alignment direction.

12. An ink-jet printer which records an image by discharging ink droplets of an ink onto a recording medium, the ink jet printer comprising:

an ink-jet head which has an ink discharge surface formed with a nozzle row, the nozzle row being formed by a plurality of nozzles from which the ink droplets are discharged and which are aligned in an alignment direction;

a carriage which carries the ink-jet head thereon and which makes the ink-jet head scan by reciprocating in a main scanning direction parallel to the ink discharge surface;

a transport mechanism which transports the recording medium in a transport direction intersecting the main scanning direction, the ink droplets discharged from the nozzles being landed on the recording medium; and a discharge controller which is configured to control the ink-jet head to discharge the ink droplets from the nozzles, wherein: an image recording area of the recording medium on which the image is to be recorded is formed by a plurality of sub recording areas disposed in the transport direction;

each of the sub recording areas is to be recorded by one scanning operation of the ink jet head in the main scanning direction;

the discharge controller is configured to control a discharge timing of the ink droplets so that the ink droplets are discharged from all of the nozzles included in the nozzle row at the same discharge timing in each scanning operation of the ink jet head; and in a case that the transport direction is inclined with respect to a sub scanning direction perpendicular to the main scanning direction so that the upstream side of the recording medium in the transport direction is positioned on one side in the main scanning direction with respect to the downstream side of the recording medium in the transport direction, the discharge controller is configured to change the discharge timing of the ink droplets for every scanning operation of the ink-jet head, such that:

under the condition that the scanning operation is performed for a central sub recording area which is included in the sub recording areas and which includes a center of the image recording area in the transport direction, the discharge controller is configured to control the ink-jet head to discharge the ink droplets from all of the nozzles included in the nozzle row at a predetermined reference timing to land the ink droplets on reference landing positions in the main scanning direction;

under the condition that the scanning operation is performed for an upstream-side sub recording area which is included in the sub recording areas and which is disposed on an upstream side in the transport direction as compared with the central sub recording area, the discharge controller is configured to change the discharge timing from the reference timing to deviate the landing positions of the ink droplets to the other side in the main scanning direction with respect to the reference landing positions; and under the condition that the scanning operation is performed for a downstream-side sub recording area which is included in the sub recording areas and which is disposed on a downstream side in the transport direction as compared with the central sub recording area, the discharge controller is configured to change the discharge timing from the reference timing to deviate the landing positions of the ink droplets to the one side in the main scanning direction with respect to the reference landing positions.

13. The ink jet printer according to claim 12, wherein: the discharge controller is configured to control the ink jet head to discharge the ink droplet in a scanning operation of the ink jet head in which the carriage is moved to the one side in the main scanning direction and in a scanning operation of the ink jet head in which the carriage is moved to the other side in the main scanning direction;

in the scanning operation in which the carriage is moved to the other side in the main scanning direction, the discharge controller is configured to delay the discharge timing as compared with the reference timing under the condition that the scanning operation is performed for the upstream-side sub recording area, and the discharge controller is configured to advance the discharge timing as compared with the reference timing under the condition that the scanning operation is performed for the downstream-side sub recording area; and in the scanning operation in which the carriage is moved to the one side in the main scanning direction, the discharge controller is configured to advance the discharge timing as compared with the reference timing under the condition that the scanning operation is performed for the upstream-side sub recording area, and the discharge controller is configured to delay the discharge timing as compared with the reference timing under the condition that the scanning operation is performed for the downstream-side sub recording area.

14. The ink-jet printer according to claim 12, wherein the discharge controller is configured to control the ink jet head to deviate the landing positions of the ink droplets with respect to the reference landing positions by a predetermined deviation amount corresponding to a distance from the central sub recording area and an angle of inclination of the transport direction with respect to the sub scanning direction under the condition that the scanning operation is performed for the upstream-side sub recording area and under the condition that the reference nozzle scanning operation is performed for the downstream-side and recording area, respectively.

15. The ink-jet printer according to claim 14, wherein: in a case that an angle, which is formed by the alignment direction and the transport direction, is not greater than a predetermined angle, the discharge controller is configured to control the ink jet head to deviate the landing positions of the ink droplets by the predetermined deviation amount under the condition that the scanning operation is performed for the upstream-side sub recording area and under the condition that the scanning operation is performed for the upstream-side sub recording area, respectively; and in a case that the angle, which is formed by the alignment direction and the transport direction, is greater than the predetermined angle, the discharge controller is configured to control the ink jet head to deviate the landing positions of the ink droplets by an amount smaller than the predetermined deviation amount under the condition that the scanning operation is performed for the upstream-side sub recording area and under the condition that the scanning operation is performed for the downstream-side sub recording area, respectively.

16. The ink-jet printer according to claim 14, wherein:

the discharge controller is configured to control the ink jet head to selectively perform anyone of borderless recording, in which the image is recorded on the image recording area extending over an entire length of the recording medium with respect to the main scanning direction by discharging the ink: droplets from the nozzles over a range wider than a range of arrangement of the recording medium with respect to the main scanning direction, and bordered recording, in which the image is recorded on the image recording area having a length with respect to the main scanning direction that is shorter than that the length of the recording medium with respect to the main scanning direction and having blank spaces disposed on both sides with respect to the main scanning direction;

in a case that the borderless recording is performed, the discharge controller is configured to control the ink jet head to deviate the landing positions of the ink droplets by the predetermined deviation amount under the condition that the scanning operation is performed for the upstream-side sub recording area and under the condition that the scanning operation is performed for the downstream-side sub recording area, respectively; and in a case that the bordered recording is performed, the discharge controller is configured to control the ink jet head to deviate the landing positions of the ink droplets by an amount smaller than the predetermined deviation amount under the condition that the scanning operation is performed for the upstream-side sub recording area and under the condition that the scanning operation is performed for the downstream-side sub recording area, respectively.

17. The ink-jet printer according to claim 14, wherein: the discharge controller is configured to control the ink-jet head to selectively perform anyone of short area recording, in which the image is recorded on the image recording area having a length with respect to the sub scanning direction that is not greater than a predetermined length, and long area recording, in which the image is recorded on the image recording area having a length with respect to the sub scanning direction that is greater than the predetermined length;

in a case that the short area recording is performed, the discharge controller is configured to control the ink jet head to deviate the landing positions by the predetermined deviation amount under the condition that the scanning operation is performed for the upstream-side sub recording area and under the condition that the scanning operation is performed for the downstream-side sub recording area, respectively; and in a case that the long area recording is performed, the discharge controller is configured to control the ink jet head to deviate the landing positions by an amount smaller than the predetermined deviation amount under the condition that the scanning operation is performed for the upstream-side sub recording area and under the condition that the scanning operation is performed for the downstream-side sub recording area, respectively.

18. The ink jet printer according to claim 12, wherein the discharge controller is configured to receive an information, which relates to the center of the image recording area with respect to the sub scanning direction, for an external apparatus which is connectable to the ink jet printer.

19. The ink jet printer according to claim 12, wherein the center of the image recording area with respect to the sub scanning direction is coincident with a center of the recording medium with respect to the sub scanning.

20. The ink jet printer according to claim 12, wherein the center of the image recording area with respect to the sub scanning direction is a center of the image with respect to the sub scanning direction.

* * * * *